US008229749B2

(12) United States Patent
Ehara et al.

(10) Patent No.: US 8,229,749 B2
(45) Date of Patent: Jul. 24, 2012

(54) WIDE-BAND ENCODING DEVICE, WIDE-BAND LSP PREDICTION DEVICE, BAND SCALABLE ENCODING DEVICE, WIDE-BAND ENCODING METHOD

(75) Inventors: Hiroyuki Ehara, Kanagawa (JP); Koji Yoshida, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1324 days.

(21) Appl. No.: 11/721,358

(22) PCT Filed: Dec. 9, 2005

(86) PCT No.: PCT/JP2005/022690

§ 371 (c)(1),
(2), (4) Date: Jun. 11, 2007

(87) PCT Pub. No.: WO2006/062202

PCT Pub. Date: Jun. 15, 2006

(65) Prior Publication Data

US 2009/0292537 A1 Nov. 26, 2009

(30) Foreign Application Priority Data

Dec. 10, 2004 (JP) ..... 2004-358260
Mar. 29, 2005 (JP) ..... 2005-095345
Sep. 30, 2005 (JP) ..... 2005-286532

(51) Int. Cl.
*G10L 13/00* (2006.01)
*G10L 19/00* (2006.01)
*G10L 21/04* (2006.01)

(52) U.S. Cl. ..... 704/262; 704/219; 704/500; 704/501; 704/502; 704/503; 704/504; 704/230

(58) Field of Classification Search ..... 704/230, 704/219, 500, 501, 502, 503, 504, 262; 700/94
See application file for complete search history.

(56) References Cited

U.S. PATENT DOCUMENTS 5,581,652 A 12/1996 Abe et al.
(Continued)

FOREIGN PATENT DOCUMENTS

JP 6-118995 4/1994
(Continued)

OTHER PUBLICATIONS

H. Ohmuro, T. Moriya, K. Mano, and S. Miki, "Vector quantization of LSP parameters using moving average interframe prediction," Electronics and Communications in Japan, Part 3, vol. 77, pp. 12-26, 1994.*

(Continued)

*Primary Examiner* — Douglas Godbold
*Assistant Examiner* — Edgar Guerra-Erazo
(74) *Attorney, Agent, or Firm* — Greenblum & Bernstein, P.L.C.

(57) ABSTRACT

There is provided a wide-band LSP prediction device and others capable of predicting a wide-band LSP from a narrow-band LSP with a high quantization efficiency and a high accuracy while suppressing the size of a conversion table correlating the narrow-band LSP to the wide-band LSP. In this device, a non-linear prediction unit (102) performs non-linear prediction by using a converted wide-band LSP inputted from a narrow-band/wide-band conversion unit (101) and inputs the non-linear prediction result to an amplifier (103). The converted wide-band LSP is inputted to an amplifier (104). An adder (122) adds multiplication results (vectors) inputted from the amplifiers (103, 104).

10 Claims, 28 Drawing Sheets

U.S. PATENT DOCUMENTS

| | | | | |
|---|---|---|---|---|
| 6,865,534 | B1 * | 3/2005 | Murashima et al. | 704/262 |
| 7,069,212 | B2 * | 6/2006 | Tanaka et al. | 704/225 |
| 7,289,952 | B2 * | 10/2007 | Yasunaga et al. | 704/216 |
| 7,483,830 | B2 * | 1/2009 | Rotola-Pukkila et al. | 704/219 |
| 7,577,563 | B2 * | 8/2009 | El-Maleh et al. | 704/201 |
| 7,596,491 | B1 * | 9/2009 | Stachurski | 704/219 |
| 7,848,922 | B1 * | 12/2010 | Jabri et al. | 704/219 |
| 8,024,181 | B2 * | 9/2011 | Ehara et al. | 704/217 |
| 2001/0027390 | A1 * | 10/2001 | Rotola-Pukkila et al. | 704/219 |
| 2002/0004716 | A1 | 1/2002 | Miet | |
| 2002/0038210 | A1 * | 3/2002 | Yajima et al. | 704/230 |
| 2002/0077812 | A1 * | 6/2002 | Suzuki et al. | 704/230 |
| 2005/0163323 | A1 | 7/2005 | Oshikiri | |
| 2005/0252361 | A1 | 11/2005 | Oshikiri | |
| 2006/0122828 | A1 * | 6/2006 | Lee et al. | 704/219 |
| 2006/0277039 | A1 * | 12/2006 | Vos et al. | 704/219 |
| 2009/0182558 | A1 * | 7/2009 | Su et al. | 704/230 |

FOREIGN PATENT DOCUMENTS

| | | |
|---|---|---|
| JP | 9-101798 | 4/1997 |
| JP | 2003-526123 | 9/2003 |
| JP | 2003-323199 | 11/2003 |
| JP | 2003-534578 | 11/2003 |
| JP | 2004-101720 | 4/2004 |

OTHER PUBLICATIONS

J. J Epps, W. H. Holmes, "A New Technique for Wideband Enhancement of Coded Narrowband Speech". IEEE Workshop on Speech Coding, Porvoo, Finland, 1999.*

Ohmuro, T. Moriya, K. Mano, and S. Miki, "Vector quantization of LSP parameters using moving average interframe prediction," Electronics and Communications in Japan, Part 3, vol. 77, pp. 12-26, 1994.*

J. Epps, W. H. Holmes, "A New Technique for Wideband Enhancement of Coded Narrowband Speech". IEEE Workshop on Speech Coding, Porvoo, Finland, 1999.*

Nomura et al., "A Bitrate and Bandwidth Scalable CELP Coder," Proceedings of the 1998 IEEE International Conference on Acoustics, Speech and Signal Processing, IEEE, vol. 1, pp. 341-344, XP010279059 (May 1998).

Koishida et al., "A 16-kbit/s Bandwidth Scalable Audio Coder Based on the G.729 Standard," Proceedings of the 2000 IEEE International Conference on Acoustics, Speech and Signal Processing, IEEE, vol. 2, pp. 1149-1152, XP010504931 (Jun. 2000).

Ehara et al., "Predictive VQ for Bandwidth Scalable LSP Quantization," Proceedings of the 2005 IEEE International Conference on Acoustics, Speech and Signal Processing, IEEE, vol. 1, pp. 137-140, XP010791993 (Mar. 2005).

International Telecommunication Union, ITU-T recommendation G.729, chapter 3.2.4, Mar. 1996.

* cited by examiner

WIDE-BAND ENCODING DEVICE, WIDE-BAND LSP PREDICTION DEVICE, BAND SCALABLE ENCODING DEVICE, WIDE-BAND ENCODING METHOD

TECHNICAL FIELD

The present invention relates to a band scaleable coding apparatus for encoding speech signals in a band-scaleable manner, a wideband coding apparatus operating as part of this apparatus, a wideband LSP (Line Spectrum Pair) prediction apparatus mounted on a wideband coding apparatus, and a band scaleable decoding apparatus for decoding such as wideband encoded data generated by this wideband coding apparatus.

BACKGROUND ART

An embedded variable rate speech encoding scheme having scalability in the signal band is attracting attention as an speech encoding scheme capable of supporting from conventional call services to active wideband speech communication services. Further, since scaleable encoding information is such that encoding information can be freely reduced at arbitrary nodes on the transmission channel, it is effective in congestion control in communication utilizing packet networks typified by an IP network. As a result of this background, band-scaleable embedded variable rate encoding schemes of speech signals are subject to standardization in ITU-T (International Telecommunication Union—Telecommunication standardization sector) SG16 (Study Group 16).

On the other hand, in speech signal encoding, LSP parameters are widely used as parameters for effectively representing spectrum envelope information and LSP parameter encoding is also one of essential, elemental technologies in band-scaleable speech encoding.

When the LSP parameters are to include band scalability, wideband LSP parameters are subjected to predictive quantization by using narrowband LSP parameters obtained by analyzing narrowband signals. Therefore, prediction accuracy and quantization efficiency in predictive quantization of wideband LSP parameters are important indicators directly influencing band scaleable encoding performance of speech signals.

As technology for performing predictive quantization of wideband LSP parameters such as these, technology is also well known (for example, refer to Patent Document 1) for predicting wideband LSP parameters from encoded narrowband LSP parameters by using non-linear prediction technology such as codebook mapping, generating the prediction difference by comparing these prediction results with actual wideband LSP parameters, and transmitting both the generated prediction difference and encoded narrowband LSP parameters. Further, technology is also well-known (for example, refer to Patent Document 2) for predicting wideband LSF parameters from narrowband LSF (Line Spectral Frequency) parameters using, for example, codebook mapping and encoding prediction residuals.

Patent Document 1: Japanese Patent Application Laid-open No. 2003-534578.

Patent Document 2: Japanese Patent Application Laid-open No. Hei6-118995.

DISCLOSURE OF INVENTION

Problems to be Solved by the Invention

However, although Patent Document 1 discloses the "concept" of predicting wideband LSP (synonymous with LSF) parameters by the method disclosed in Patent Document 2 and encoding a prediction residual, using only codebook mapping technology is described as the specific details.

Here, when wideband LSP parameters are predicted by the method disclosed in Patent Document 2, quantization performance depends on prediction performance and, further, this prediction performance depends on the conversion table size and learning data generated by using the conversion table. If a large size conversion table is designed by using a large amount of learning data, various narrowband signals can be associated with wideband signals and typically excellent prediction performance can be achieved. On the other hand, generating and using a limitless number of conversion tables by using massive amounts of learning data in actual applications is impossible. Therefore, in reality, conversion tables with an appropriate size to a certain extent are generated and used by using learning data with a limited amount to a certain extent. Since the size of the conversion table relates not only to the amount of memory but also to the amount of arithmetic processing required in conversion processing, the size of the conversion table has to be made small for applications, such as ones used in mobile terminals, that have the restricted amount of memory and arithmetic processing. When the size of the conversion table is small, association of the narrowband signal with the wideband signal is limited, and prediction performance of wideband LSP parameters is lowered. Namely, if the size of this conversion table is not sufficiently large, the quantization efficiency in non-linear prediction of wideband LSP parameters from narrowband LSP parameters falls, and, in particular, there are cases where quality of low band components which show characteristics of the speech signal deteriorate by performing non-linear prediction.

In this way, Patent Document 1 does not suggest technological problems occurring in predicting wideband LSP parameters from narrowband LSP parameters using only codebook mapping technology and does not disclose an idea for means for solving the problems naturally. Namely, applying the codebook mapping technology disclosed in Patent Document 2 as is to the technology disclosed in Patent Document 1, can not reliably improve quantization efficiency and prediction accuracy in predicting wideband LSP parameters from narrowband LSP parameters.

Therefore, it is an object of the present invention to provide such as a wideband coding apparatus capable of minimizing the size of a conversion table associating a narrowband LSP with a wideband LSP and predicting a wideband LSP from a narrowband LSP with high quantization efficiency and with excellent accuracy.

Means for Solving the Problem

A wideband coding apparatus according to the present invention that encodes a wideband LSP using a quantized narrowband LSP of a speech signal employs a configuration of a conversion section that converts the quantized narrowband LSP to a first wideband LSP comprising information about quantized narrowband LSP by up-sampling, a prediction section that predicts a second wideband LSP from the first LSP by non-linear prediction processing, a generating section that generates a predicted wideband LSP using a weighted sum of the first LSP and the second LSP, and an encoding section that obtains encoded data that minimize a difference between the predicted wideband LSP and the wideband LSP.

A wideband LSP prediction apparatus according to the present invention that predicts a wideband LSP from a quantized narrowband LSP of a speech signal employs a configuration of a conversion section that converts the quantized narrowband LSP to a first wideband LSP comprising information about quantized narrowband LSP by up-sampling, a prediction section that predicts a second wideband LSP from the first LSP by non-linear prediction processing, and a generating section that generates a predicted wideband LSP using a weighted sum of the first LSP and the second LSP.

According to the present invention, weightings are assigned to a wideband LSP (first LSP) converted by up-sampling a quantized narrowband LSP of a speech signal and assigned to non-linear prediction results (second LSP) for performing non-linear prediction using this converted wideband LSP, and a wideband LSP of the speech signal is then predicted from the quantized narrowband LSP using the addition result. Further, the difference between the predicted wideband LSP obtained by this prediction and a separately inputted wideband LSP is then obtained, and encoding of the wideband LSP is performed by minimizing the difference.

Further, a wideband coding apparatus according to the present invention may be mounted on a band scaleable coding apparatus for generating encoded data having scalability in a frequency domain and a corresponding band scaleable decoding apparatus.

Advantageous Effect of the Invention

According to the present invention, in band scalable encoding of speech signals, it is possible to minimize the size of various codebooks configured from a plurality of various encode vectors that are reference vectors representing a converted wideband LSP and a wideband LSP of speech signals and improve both quantization efficiency and accuracy of prediction in predicting a wideband LSP of speech signals from a quantized narrowband LSP.

BEST MODE FOR CARRYING OUT THE INVENTION

The embodiment of the present invention will be described with reference to the drawings. In the present invention, LSP parameters obtained by analyzing a speech signal are simply referred to as "LSP". Further, in the present invention, "ISP" (Immittance Spectral Pair) can be used in place of "LSP".

(Embodiment 1)

Figure 1:
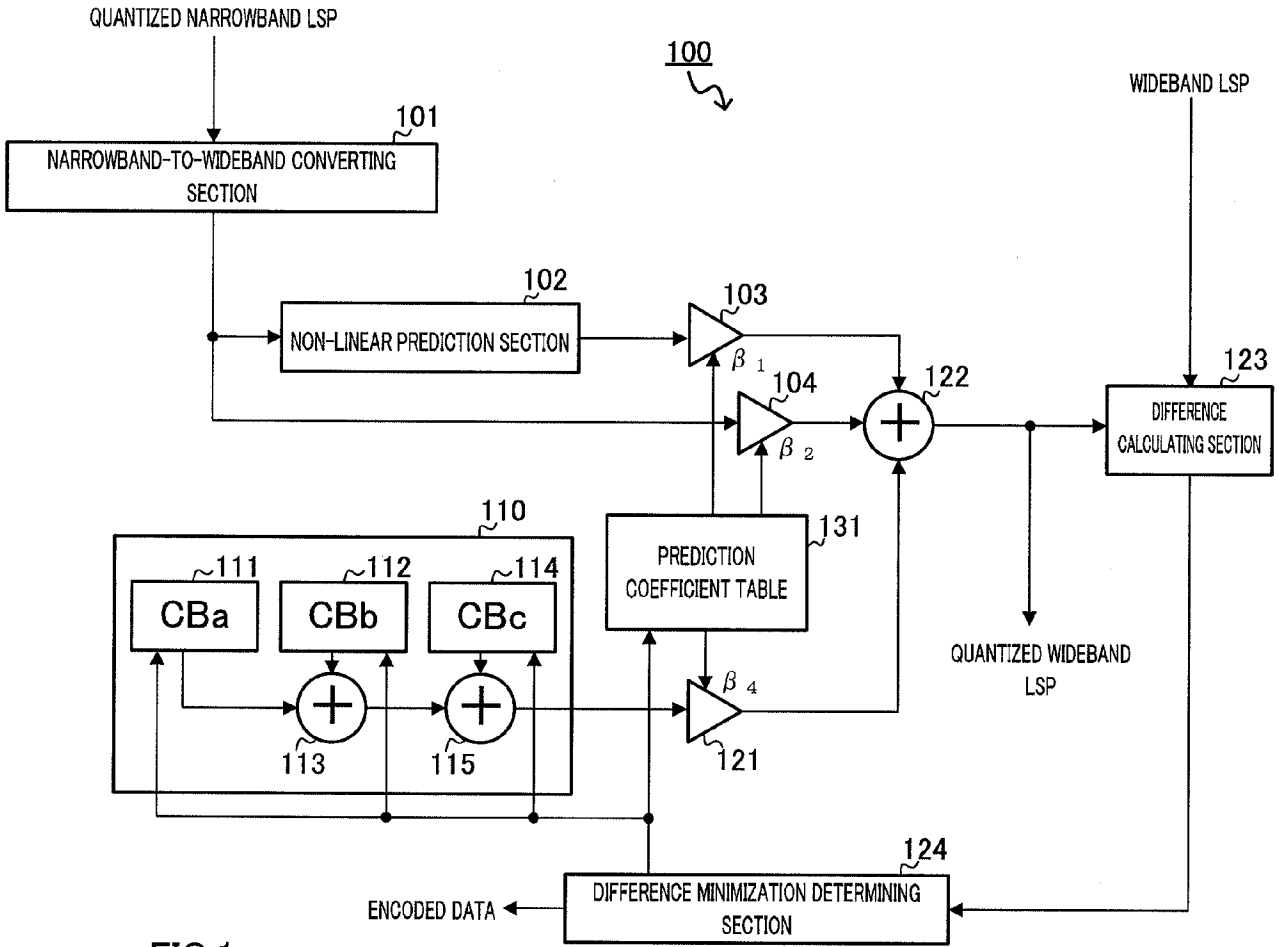
FIG. 1 is a block diagram showing main components of a wideband coding apparatus according to Embodiment 1.

FIG. 1 is a block diagram showing the main components of wideband coding apparatus 100 has a wideband LSP prediction apparatus according to Embodiment 1 of the present invention. A case will be described here with the present embodiment where wideband coding apparatus 100 is used as part of a band scaleable coding apparatus. The wideband LSP prediction apparatus, wideband coding apparatus and band scaleable coding apparatus of the present embodiment may be mounted on communication terminal apparatus such as mobile telephones, base station apparatuses.

Wideband coding apparatus 100 has narrowband-to-wideband converting section 101, non-linear prediction section 102, amplifiers 103, 104 and 121, LSP prediction residual codebook 110, adder 122, difference calculating section 123, difference minimization determining section 124 and prediction coefficient table 131. Further, LSP prediction residual codebook 110 is a codebook having a three-stage configuration and has first-stage codebook (CBa) 111, second-stage codebook (CBb) 112, adders 113 and 115, and third-stage codebook (CBc) 114.

Narrowband-to-wideband converting section 101 up-samples a quantized narrowband LSP of a speech signal inputted from a narrowband LSP quantizer (not shown), using, for example, following equation 1, converts the results to a wideband LSP, and inputs the obtained converted wideband LSP to non-linear prediction section 102 and amplifier 104.

$$fw(i) = 0.5 \times fn(i) \quad [\text{where } i = 0, \ldots, Pn-1] \qquad \text{(Equation 1)}$$
$$= 0.0 \quad [\text{where } i = Pn, \ldots, Pw-1]$$

In equation 1, fw(i) indicates the i-th order wideband LSP of a speech signal, fn(i) indicates the i-th order narrowband LSP of a speech signal, Pn indicates the LSP analysis order of a narrowband LSP, and Pw indicates the LSP analysis order of a wideband LSP (for example, refer to Japanese Patent Application Laid-Open No. Hei11-30997).

Non-linear prediction section 102 performs non-linear prediction of a wideband LSP of a speech signal using a converted wideband LSP inputted from narrowband-to-wideband converting section 101, and inputs the non-linear prediction result to amplifier 103. The internal configuration of non-linear prediction section 102 and its operation will be described later.

Amplifier 103 multiplies the non-linear prediction results inputted from non-linear prediction section 102 with the weighting coefficient $\beta_1$ (having values for vector elements) reported from prediction coefficient table 131 (described later), and inputs the multiplication results to adder 122.

Adder 104 multiplies the converted wideband LSP inputted from narrowband-to-wideband converting section 101 with the weighting coefficient $\beta_2$ reported from prediction coefficient table 131, and inputs the multiplication result to adder 122. In the present embodiment, the addition result of the multiplication result in amplifier 103 and the multiplication result in amplifier 104, is the prediction result of the wideband LSP of the speech signal.

LSP prediction residual codebook 110 is a codebook that has a plurality of LSP prediction residual code vectors, which are reference vectors representing the residual between the prediction result of a wideband LSP of a speech signal and the wideband LSP of this speech signal, and that, in accordance with a report from difference minimization determining section 124 (described later), generates and inputs to amplifier 121 the reported LSP prediction residual code vectors.

CBa 111 inputs the reported first-stage code vector to adder 113 in accordance with a report from difference minimization determining section 124.

CBa 112 inputs the reported second-stage code vector to adder 113 in accordance with a report from difference minimization determining section 124.

Adder 113 adds the first-stage code vector inputted from CBa 111 and the second-stage code vector inputted from CBb 112 and inputs the addition result to adder 115.

CBc 114 inputs the reported third-stage code vector to adder 115 in accordance with a report from difference minimization determining section 124.

Adder 115 adds the addition result inputted from adder 113 and the third-stage code vector inputted from CBc 114, and inputs this addition result to amplifier 121 as an LSP prediction residual code vector.

Amplifier 121 multiplies a LSP prediction residual code vector inputted from LSP prediction residual codebook 110 with the weighting coefficient $\beta_4$ specified by prediction coefficient table 131, and inputs this multiplication result to adder 122.

Adder 122 adds the multiplication results (vectors) inputted from amplifiers 103, 104 and 121 and inputs this addition result to difference calculating section 123 as a quantized wideband LSP candidate. Further, when difference minimization determining section 124 (described later) determines the first-stage code vector to third-stage code vector and prediction coefficient set, adder 122 outputs the addition results at this time to outside wideband coding apparatus 100 as quantized wideband LSPs when necessary. A quantized wideband LSP outputted thus to outside is used in processing in other blocks (not shown) for speech signal encoding.

difference calculating section 123 calculates differences between a wideband LSP of a quantization-target speech signal and the addition results (quantized wideband LSP candidates) inputted from adder 122, and inputs the calculated differences to difference minimization determining section 124. The differences calculated in difference calculating section 123 may be square differences between inputted LSP vectors. Further, if weighting is performed in accordance with the characteristics of inputted LSP vectors, auditory quality can be further improved. For example, difference minimization is performed using weighting square differences (weighting Euclidean distance) of the equation (21) in chapter 3.2.4 ("Quantization of the LSP coefficients") of ITU-T recommendation G.729.

Difference minimization determining section 124 determines the first-stage code vector to third-stage code vector and prediction coefficient set that are inputted from difference calculating section 123 and that minimize the difference, generates encoded data that represents the determined first-stage code vector to third-stage code vector and prediction coefficient set, and inputs the generated encoded data to, for example, a radio transmitting section (not shown). Upon determining the first-stage code vector to third-stage code vector and prediction coefficient set that are inputted from difference calculating section 123 and that minimize difference, difference minimization determining section 124 reports to CBa 111, CBb 112, CBc 114 and prediction coefficient table 131 to change their outputs when necessary. That is, difference minimization determining section 124 determines, by trial and error, the first-stage code vector to third-stage code vector and prediction coefficient set indicated by the encoded data.

Prediction coefficient table 131 stores a plurality of prediction coefficient sets, which are combinations of weighting coefficients to report to amplifiers 103, 104 and 121, and, in accordance with a report from difference minimization determining section 124, selects the one reported set out of the stored prediction coefficient sets, and commands amplifiers 103, 104 and 121 to use the weighting coefficient included in the selected prediction coefficient set.

Wideband coding apparatus 100 has a radio transmitting section (not shown) and generates a radio signal including encoded data which is a quantized narrowband LSP of a speech signal encoded by a predetermined scheme, and encoded data which indicates the first-stage code vector to third-stage code vector and prediction coefficient set that are inputted from difference minimization determining section 124 and that minimize the difference between the quantized wideband LSP of the speech signal (that is, encoded data that forms the quantized wideband LSP), and performs radio transmission of the generated radio signal to communication terminal apparatus such as a mobile telephone on which wideband decoding apparatus 300 (described later) is mounted. The radio signal transmitted from wideband coding apparatus 100 is first received and amplified by base station apparatus and then received by wideband decoding apparatus 300.

Figure 2:
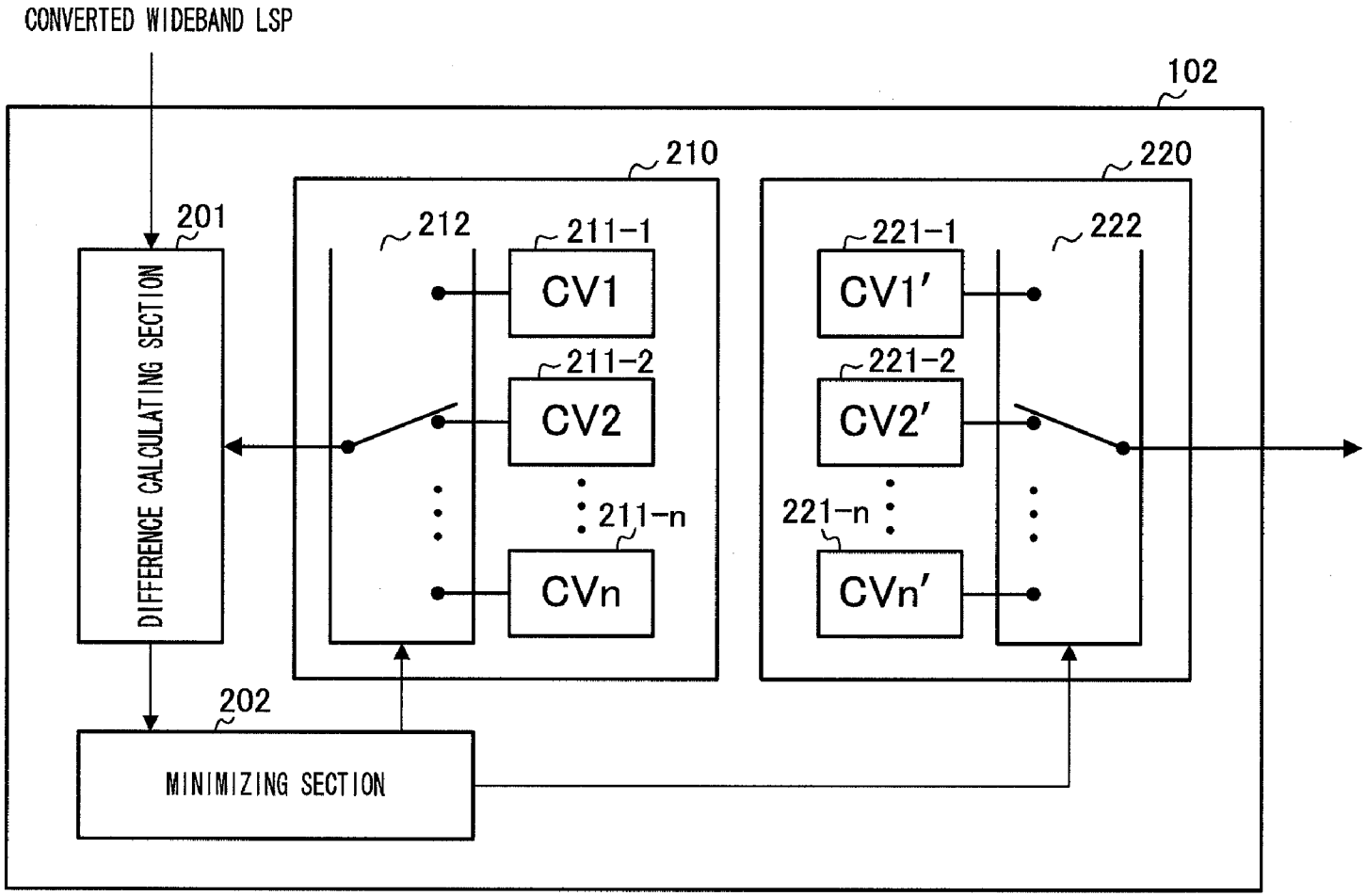
FIG. 2 is a block diagram showing the main internal configuration of a non-linear prediction section in Embodiment 1.

FIG. 2 is a block diagram showing a main internal configuration of non-linear prediction section 102 according to the present embodiment. Non-linear prediction section 102 has difference calculating section 201, minimizing section 202, classification codebook 210 and wideband codebook 220. Further, classification codebook 210 has n classification code vector storage sections 211 for storing classification code vectors (CVk: k=1 to n) and selecting section 212. Moreover, wideband codebook 220 has n individual wideband code vector storage sections 221 for storing wideband code vectors (CVk': k=1 to n) and selecting section 222. Here, one type of CVk is stored in one classification code vector storage section 211, and, similarly, one type of CVk' is stored in one wideband code vector storage section 221. Although in FIG. 2 different branch numbers are assigned to a plurality of components implementing the same functions, in this specification, the branch numbers are omitted when these components are described collectively.

Narrowband-to-wideband converting section 101 performs up-sampling which simply converts the dimension of a narrowband LSP to the dimension of a wideband LSP. According to this up-sampling, narrowband LSP characteristics are reflected on a wideband LSP, and the original narrowband LSP characteristics appear in the lower band of the converted wideband LSP (i.e. the band where the narrowband LSP is defined). Accordingly, the converted wideband LSP obtained in narrowband-to-wideband converting section 101 seems to be in the upper wideband as a result of up-sampling, but is still substantially a speech signal of narrowband data. Non-linear prediction section 102 subjects the converted wideband LSP to vector quantization by codebook mapping as described below using a narrowband codebook (classification codebook 210) and a wideband codebook (wideband codebook 220), and outputs the obtained code vector as a non-linear prediction result of the wideband LSP of a speech signal.

Difference calculating section 201 sequentially calculates the square differences between the converted wideband LSP inputted from narrowband-to-wideband converting section 101 and CVk (k=1 to n) inputted sequentially from classification codebook 210 (described later), and inputs the calculation result to minimizing section 202. Difference calculating section 201 may calculate the Euclidean distance (i.e. square differences) between the vectors or calculate the weighted Euclidean distance (i.e. weighted square differences) between the vectors.

Minimizing section 202 instructs selecting section 212 so that CVk+1 is inputted from classification codebook 210 to difference calculating section 201 each time the square difference between a converted wideband LSP and CVk is inputted from difference calculating section 201, stores the square differences of CV1 to CVn, specifying CVk indicating the stored minimum square difference, and reports "k" of the specified CVk, to selecting section 222 of wideband codebook 220.

Classification codebook 210 has a plurality of CVks and inputs CVks specified by minimizing section 202 to difference calculating section 201.

Classification code vector storage section 211 stores CVk, which is a reference vector representing a converted wideband LSP, and inputs CVk to be stored to difference calculating section 201 through selecting section 212, when connected with difference calculating section 201 by selecting section 212.

Selecting section 212 sequentially switches classification code vector storage sections 211-1 to 211-n connected to difference calculating section 201 in accordance with the designation by minimizing section 202, and sequentially inputs CV1 to CVn to difference calculating section 201.

Wideband codebook 220 has a plurality of CVk's associated with CVk, selects CVk' associated with the CVk specified by minimizing section 202 as a non-linear prediction result according to the designation from minimizing section 202, and inputs the selected non-linear prediction result to amplifier 103.

Wideband code vector storage sections 221 has a plurality of CVk's associated with CVks, and inputs CVk's to be stored, to amplifier 103, when connected to amplifier 103 by selecting section 222 (described later). Association between CVk and CVk' are designed using learning data. To be more specific, narrowband spectrum data and wideband spectrum data constituting a pair is generated from a speech signal that is to be learning data, CVk is made by clustering narrowband spectrum data (or wideband spectrum data) into n classes using such as LBG algorithm. CVk and CVk' are associated by calculating an average value of wideband spectrum data (or narrowband spectrum data) constituting a pair with spectrum data clustered into classes and making CVk' of wideband n classes.

Selecting section 222 connects wideband code vector storage section 221 storing CVk' associated with CVk specified by minimizing section 202 with amplifier 103 when k is reported from minimizing section 202.

In this way, in the present embodiment, non-linear prediction is performed using codebook mapping technology in non-linear prediction section 102.

Figure 3:
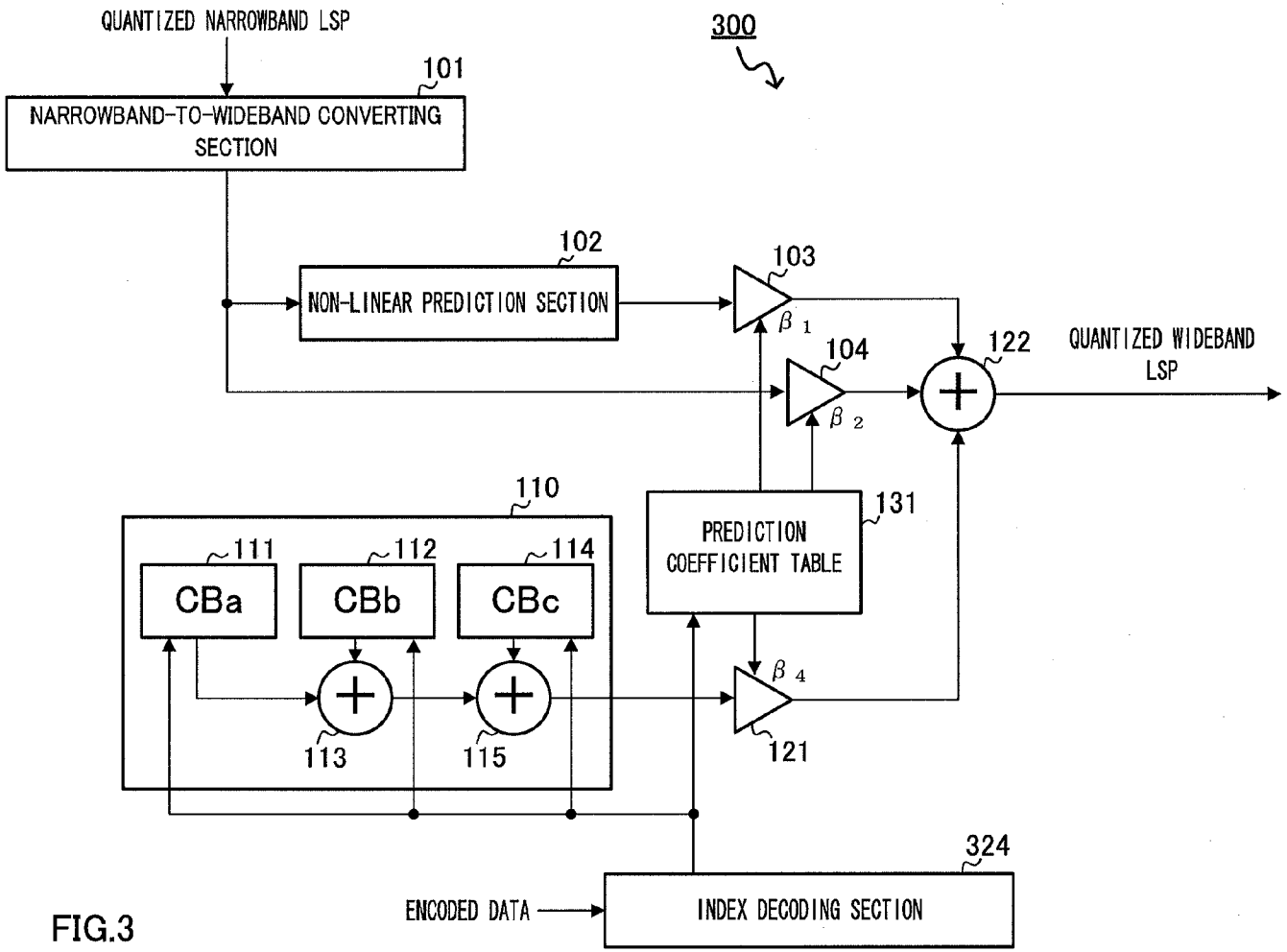
FIG. 3 is a block diagram showing main components of a wideband decoding apparatus according to Embodiment 1.

FIG. 3 is a block diagram showing the main components of wideband decoding apparatus 300 having a wideband LSP prediction apparatus according to the present embodiment. Wideband decoding apparatus 300 has narrowband-to-wideband converting section 101, non-linear prediction section 102, amplifiers 103, 104 and 121, LSP prediction residual codebook 110, adder 122, prediction coefficient table 131 and index decoding section 324. Wideband decoding apparatus 300 has a large number of the same components as wideband coding apparatus 100 and, therefore, the same components are not described here in the present embodiment.

Index decoding section 324 receives encoded data constituting a quantized wideband LSP included in the radio signal transmitted from wideband coding apparatus 100, and reports, to CBa 111, CBb 112 and CBc 114 of LSP prediction residual codebook 110 and prediction coefficient table 131 in wideband decoding apparatus 300, the first-stage code vector to third-stage code vector and prediction coefficient set to be outputted.

Wideband decoding apparatus 300 has a radio receiving section (not shown) where radio signals sent from wideband coding apparatus 100 are received and encoded data representing the quantized narrowband LSP of a speech signal included in this radio signal and encoded data constituting the quantized wideband LSP, are extracted. Further, wideband decoding apparatus 300 has a narrowband LSP decoding section (not shown) where the quantized narrowband LSP of the speech signal extracted in the radio receiving section is decoded. In wideband decoding apparatus 300, the radio receiving section (not shown) inputs encoded data constituting the extracted quantized wideband LSP to index decoding section 324, and narrowband LSP decoding section (not shown) inputs the quantized narrowband LSP of the decoded speech signal, to narrowband-to-wideband converting section 101.

Therefore, wideband decoding apparatus 300 has the same components as wideband coding apparatus 100, and generates the same quantized wideband LSP as the quantized wideband LSP generated by wideband coding apparatus 100, by causing the components to operate based on the quantized narrowband LSP of the speech signal generated by wideband coding apparatus 100 and encoded data constituting the quantized wideband LSP.

In this way, with the present embodiment, the wideband LSP of speech signal is predicted using the sum of the non-linear prediction result multiplied with the weighting coefficient $\beta_1$ and the converted wideband LSP multiplied with the weighting coefficient $\beta_2$, the residual between the prediction result and the actual wideband LSP of the speech signal is then calculated, and the LSP prediction residual code vector that is the closest to this residual is generated. Further, in the present embodiment, a quantized wideband LSP is generated by adding the prediction result of the wideband LSP of the speech signal and the vector obtained by multiplying the LSP prediction residual code vector with the weighting coefficient $\beta_4$. According to the present embodiment, rather than predicting a wideband LSP of a speech signal using non-linear prediction alone or up-sampling alone as in the conventional method, a prediction value by non-linear prediction and a prediction value by up-sampling are both utilized to a maximum degree. As a result, according to the present embodiment, it is possible to improve prediction performance when a wideband LSP of speech signal is predicted from a quantized narrowband LSP of the speech signals, and, as a result, it is possible to improve quantization performance in this case.

Further, in the present embodiment, analogous values within the same frame are considered together, and this is equivalent to performing prediction utilizing inter-frame correlation, so that prediction performance can be improved, and, as a result, quantization performance in this case can be improved.

Moreover, according to the present embodiment, as quantized wideband LSP candidates are constituted of combinations of vectors generated by different signal processings, when prediction performance of non-linear prediction section 102 is low, it is possible to improve prediction accuracy of a quantized wideband LSP by appropriately adjusting the weighting coefficients to specify to amplifiers 103, 104 and 121. Therefore, according to the present embodiment, the conditions required with regards to prediction performance of non-linear prediction section 102 can be moderated. Here, typically, the amount of memory and the number of arithmetic operations required for non-linear prediction increases as the prediction performance of the nonlinear prediction becomes higher. As a result, moderating conditions required for prediction performance of nonlinear prediction as described above means being capable of keeping the amount of memory and the amount of operation processing low. According to the present embodiment, the effect of non-linear prediction can be utilized to a maximum degree within a specified range of the amount of memory and the amount of arithmetic processing when the amount of memory and the amount of operation processing are limited in non-linear prediction section 102. In other words, according to the present embodiment, as prediction performance of a quantized wideband LSP can be made higher and the degree of freedom in designing a plurality of prediction components and weighting coefficients multiplied with the prediction coefficients can be improved, the balance of error robustness and quantization performance of a wideband coding apparatus can be arbitrarily set.

In the present embodiment, the following modifications and applications are also possible.

Although a case has been described with the present embodiment where non-linear prediction is performed by using codebook mapping technology in non-linear prediction section 102, the present invention is by no means limited to this, and non-linear prediction may be performed by using, for example, mapping conversion employing a neural network or transform function in non-linear prediction section 102, for example.

Further, although a case has been described with the present embodiment where CVk and CVk' are associated one-to-one in non-linear prediction section 102, the present invention is by no means limited to this, and association of one CVk with a plurality of CVk' may be made and, further, information necessary for selection of CVk' may be transmitted from classification codebook 210 to wideband codebook 220 for example. In this way, non-linear prediction performance can be effectively improved without substantially increasing the amount of transmission data necessary for nonlinear prediction in nonlinear prediction section 102.

Figure 4:
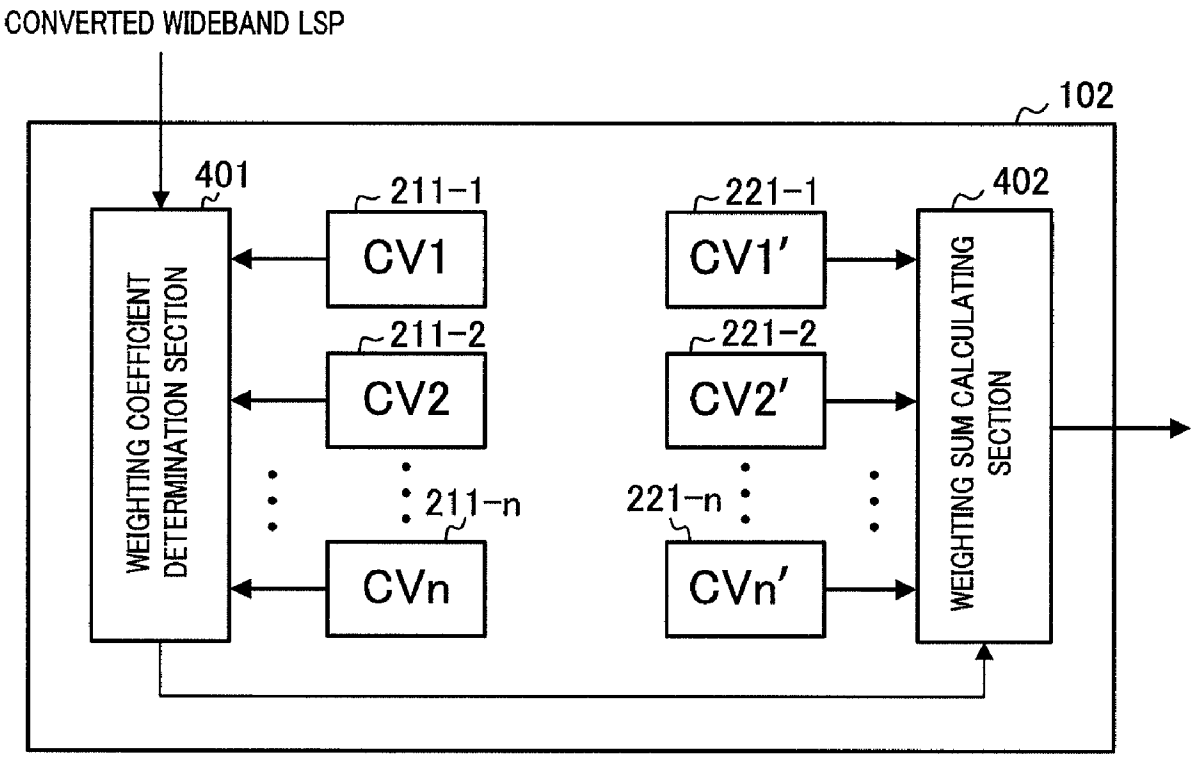
FIG. 4 is a block diagram showing a modified example of a non-linear prediction section in Embodiment 1.

Further, although a case has been described with the present embodiment where the main internal configuration of non-linear prediction section 102 can be configured as shown in FIG. 2, the present invention is by no means limited to this, and the main internal configuration of non-linear prediction section 102 may also be configured as shown in FIG. 4 for example.

Here, FIG. 4 is a block diagram showing a main internal configuration of non-linear prediction section 102 for a modified example of the present embodiment. In this modified example also, non-linear prediction section 102 performs non-linear prediction by using the codebook mapping technology.

In the modified example shown in FIG. 4, non-linear prediction section 102 has classification code vector storage section 211, wideband code vector storage sections 221, weighting coefficient determination section 401, and weighting sum calculating section 402. In this modified example, classification code vector storage section 211 and wideband code vector storage sections 221 are associated in the same manner as the present embodiment, and weighting coefficient determination section 401 multiplies by trial and error weighting coefficients with CVks, determines combinations of weighting coefficients that minimize the difference between the multiplication results and the converted wideband LSP, and reports the determined combinations of weighting coefficients to weighting sum calculating section 402.

Upon a report of the combinations of determined weighting coefficients from weighting coefficient determination section 401, weighting sum calculating section 402 extracts CVk' associated with CVk from wideband code vector storage sections 221, multiplies the extracted CVk' with the reported weighting coefficients, adds the multiplication results, and inputs the addition results as non-linear prediction results to amplifier 103.

In this way, according to the modified example shown in FIG. 4, non-linear prediction results inputted from nonlinear prediction section 102 to amplifier 103 are configured of the sum total of a plurality of CVk's multiplied with the weighting coefficients so that it is possible to perform fine adjustment of non-linear prediction results and increase dramatically prediction performance of nonlinear prediction section 102.

Figure 5:
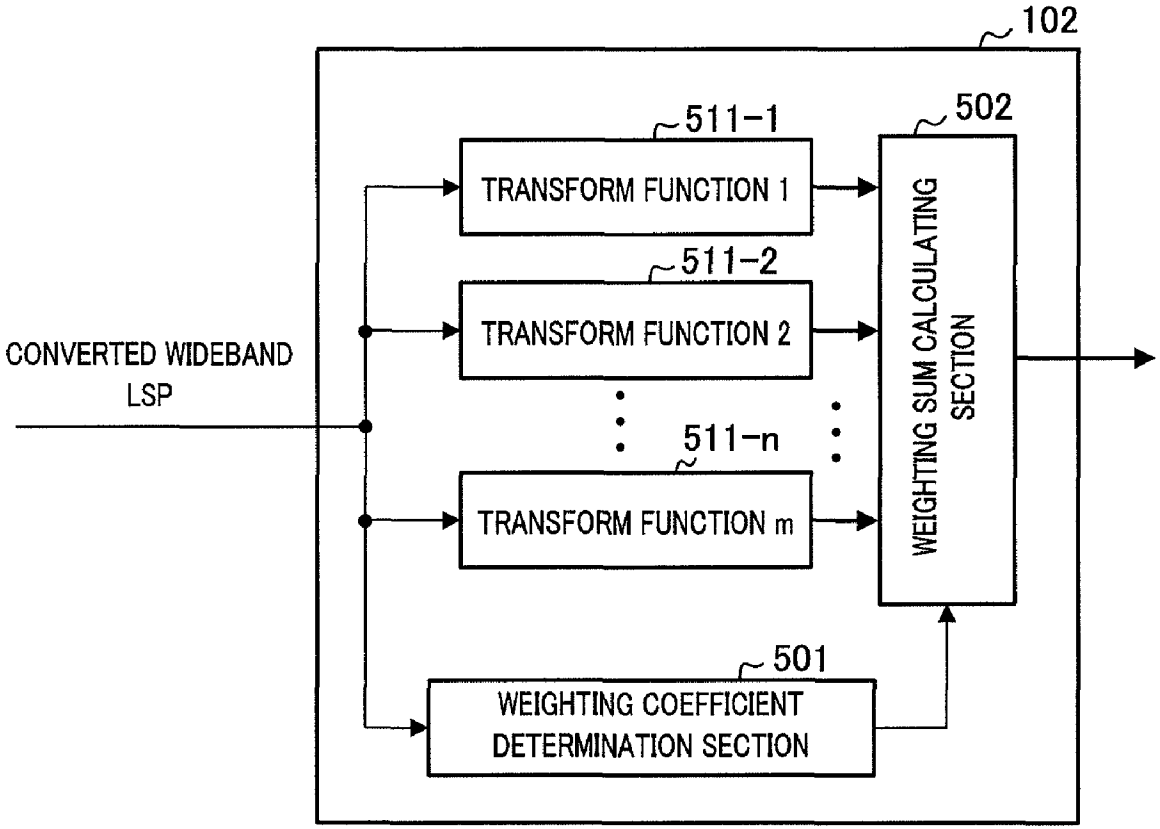
FIG. 5 is a block diagram showing a modified example of a non-linear prediction section in Embodiment 1.

Further, in the present invention, the main internal configuration of non-linear prediction section 102 may be configured as shown in FIG. 5, for example. Here, FIG. 5 is a block diagram showing a main internal configuration of non-linear prediction section 102 for a modified example of the present embodiment.

In the modified example shown in FIG. 5, non-linear prediction section 102 performs non-linear prediction by using a plurality of transform functions. In this modified example, non-linear prediction section 102 has weighting coefficient determination section 501, weighting sum calculating section 502, and m transform function storage sections 511 holding transform function k (k=1 to m).

Transform function storage sections 511 convert the vectors using transform function k (k=1 to m) holding a converted wideband LSP inputted from narrowband-to-wideband converting section 101, and input the converted vectors to weighting sum calculating section 502. Transform function k can be made in advance by using learning data but is not particularly limited.

Weighting coefficient determination section 501 determines weighting coefficients multiplied with vectors inputted from transform function storage sections 511 to weighting sum calculating section 502. Namely, weighting coefficient determination section 501 determines the weighting coefficient using a converted wideband LSP inputted from narrowband-to-wideband converting section 101 and reports the determined weighting coefficient to weighting sum calculating section 502. A determining method of these weighting coefficients includes, for example, a method for learning and designing specific transform functions for input vectors close to, for example, specific representative vectors and determining based on the degree of similarity to representative vectors allocated to transform functions.

Weighting sum calculating section 502 multiplies weighting coefficients reported from weighting coefficient determination section 501 with vectors inputted from transform function storage sections 511, adds all the multiplication results, and inputs the addition result to amplifier 103 as non-linear prediction result.

Further, although a case has been described with the present embodiment where LSP prediction residual codebook 110 and prediction coefficient table 131 are not associated with non-linear prediction section 102, the present invention is by no means limited to this, and, for example, classification of converted wideband LSPs may be performed utilizing classification results k determined in nonlinear prediction section 102 and weighting coefficient sets, and LSP prediction residual codebook 110 and prediction coefficient table 131 different per determined classes may be switched and used. In this way, when LSP prediction residual codebooks and prediction coefficient tables are subjected to multimode information obtained during non-liner prediction processing is only utilized so that prediction performance of non-linear prediction section 102 can be substantially improved without further processing and transmission information for mode determination required.

(Embodiment 2)

Figure 6:
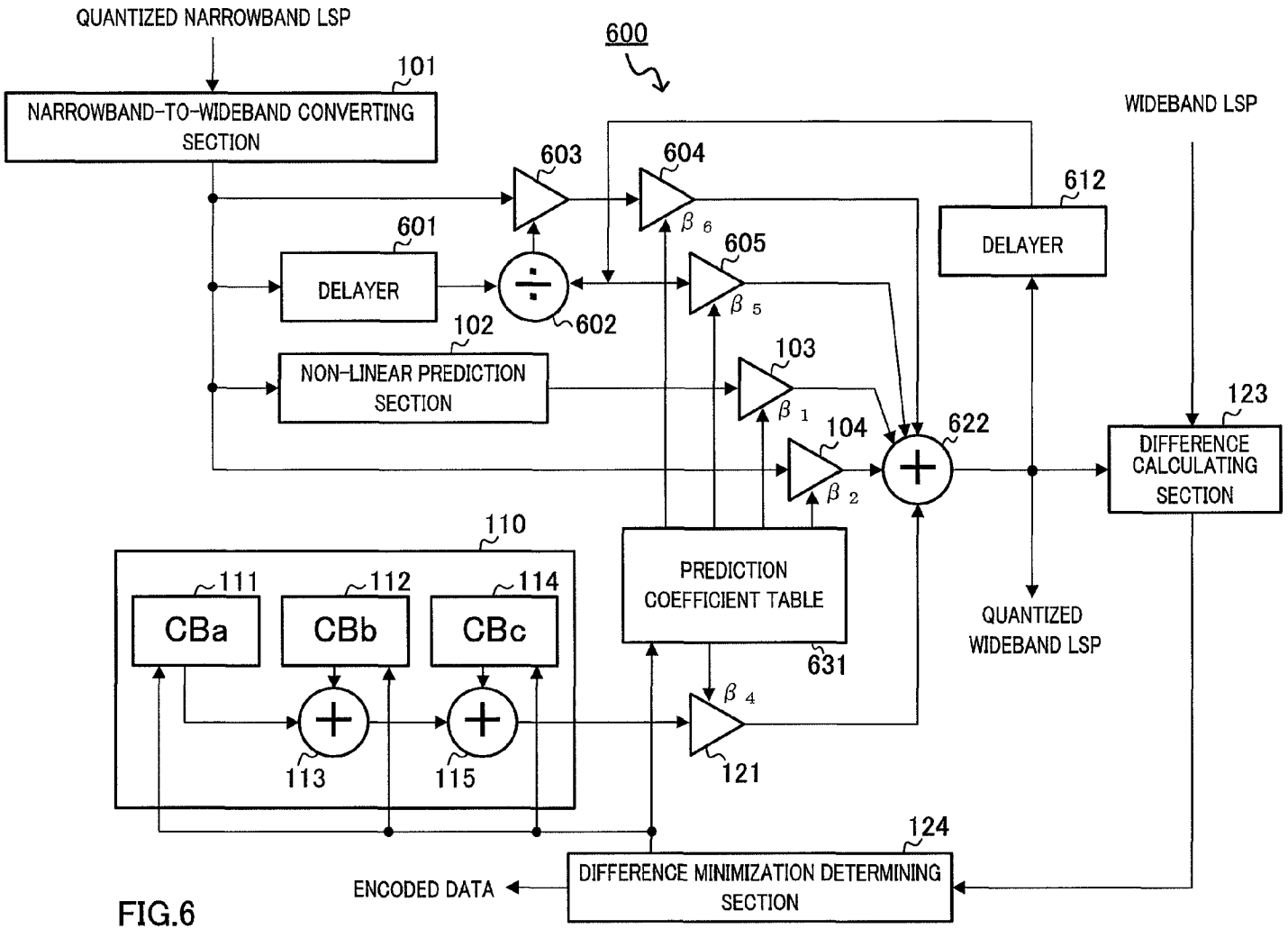
FIG. 6 is a block diagram showing main components for a wideband coding apparatus according to Embodiment 2.

FIG. 6 is a block diagram showing the main components of wideband coding apparatus 600 having a wideband LSP prediction apparatus of Embodiment 2 according to the present invention. Wideband coding apparatus 600 has adder 622 and prediction coefficient table 631 in place of adder 122 and prediction coefficient table 131 in wideband coding apparatus 100 according to Embodiment 1, and has further delayers 601 and 612, divider 602 and amplifiers 603, 604 and 605. Thus, wideband coding apparatus 600 has a large number of the components performing the same operation in wideband coding apparatus 100, therefore, in the present embodiment, components of wideband coding apparatus 600 different from wideband coding apparatus 100 will be described for avoiding repetition.

Delayer 601 delays the converted wideband LSP inputted from narrowband-to-wideband converting section 101 by time for one frame, and inputs a delayed converted of a previous frame wideband LSP to divider 602.

Divider 602 divides the converted wideband LSP of a previous frame inputted from delayer 601 by a quantized wideband LSP of a previous frame inputted from delayer 612 (described later), and inputs the division result to amplifier 603.

Amplifier 603 then multiplies the converted wideband LSP inputted from narrowband-to-wideband converting section 101 with the division result inputted from divider 602 as an amplification coefficient, and inputs the multiplication result to amplifier 604.

Amplifier 604 then multiplies weighting coefficient $\beta_6$ specified from prediction coefficient table 631 with the converted wideband LSP inputted from amplifier 603, and inputs the multiplication result to adder 622.

Amplifier 605 multiplies the quantized wideband LSP of a previous frame inputted from delayer 612 with prediction coefficient $\beta_5$ instructed from prediction coefficient table 631, and inputs the multiplication result to adder 622.

Adder 622 adds the multiplication results inputted from amplifiers 103, 104, 121, 604, and 605 and inputs the addition result, i.e. a quantized wideband LSP candidate, to difference calculating section 123. A quantized wideband LSP that is outputted by adder 622 when first-stage to third-stage code vectors and a prediction coefficient set that are determined by difference minimization determining section 124 and minimize the difference are used, is inputted to delayer 612 and is outputted to outside wideband coding apparatus 600 when necessary.

Delayer 612 delays the quantized wideband LSP inputted from adder 622 by time for one frame and inputs the quantized wideband LSP of a previous frame to divider 602 and amplifier 605 respectively.

Prediction coefficient table 631 stores a plurality of prediction coefficient sets that are combinations of weighting coefficients to be reported to amplifiers 103, 104, 121, 604 and 605, selects one set reported from among the prediction coefficient sets to store, and specifies to amplifiers 103, 104, 121, 604 and 605 respectively weighting coefficients of selected prediction coefficients according to a report from difference minimization determining section 124.

Figure 7:
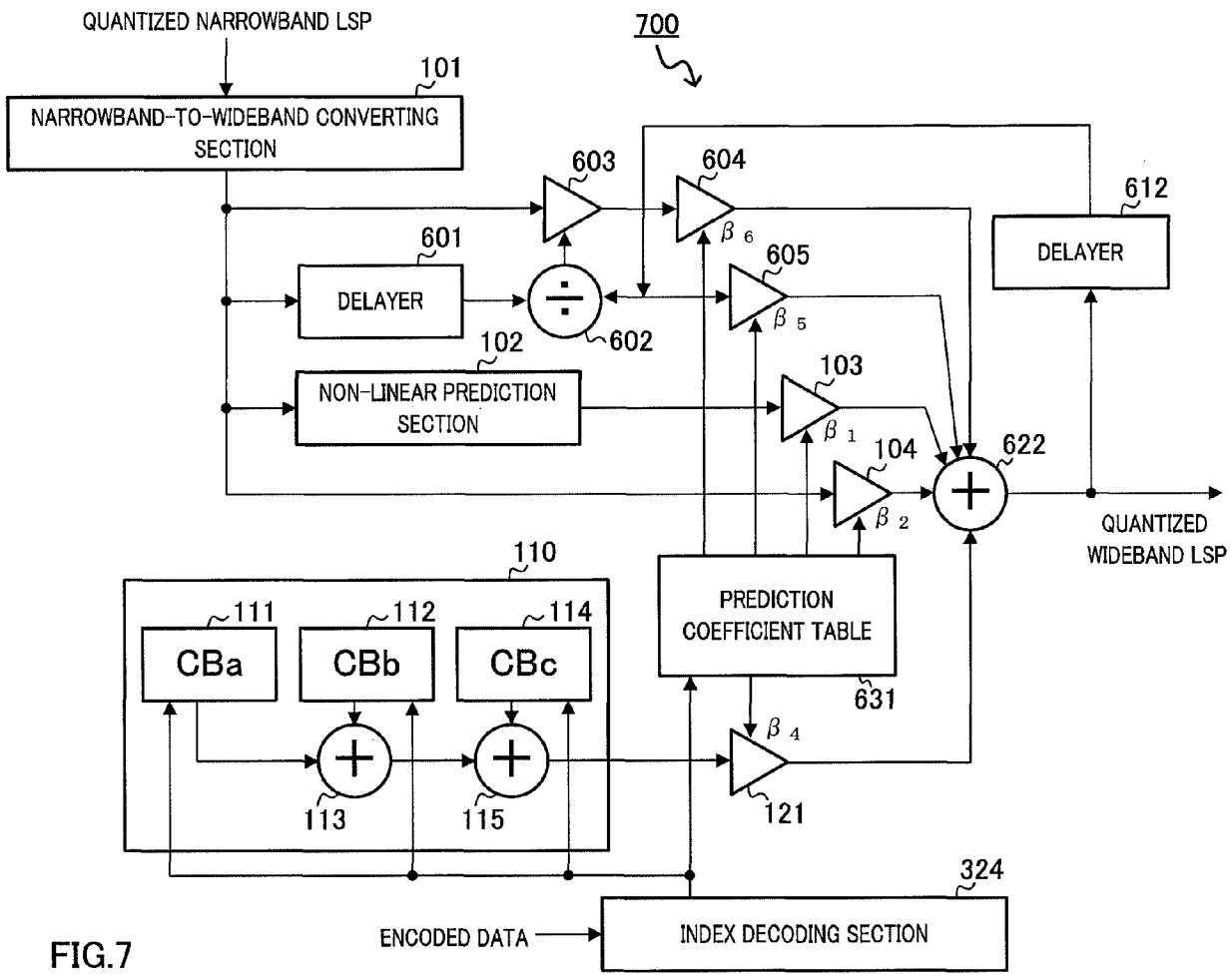
FIG. 7 is a block diagram showing main components of a wideband decoding apparatus according to Embodiment 2.

FIG. 7 is a block diagram showing the main components of wideband decoding apparatus 700 having a wideband LSP prediction apparatus of Embodiment 2 of the present invention. Wideband decoding apparatus 700 has adder 622 and prediction coefficient table 631 in place of adder 122 and prediction coefficient table 131 and further has delayers 601 and 612, divider 602 and amplifiers 603, 604 and 605 in wideband decoding apparatus 300 according to Embodiment 1. Thus, the main components of wideband decoding apparatus 700 all performs the same operations as in wideband decoding apparatus 300 and wideband coding apparatus 600, therefore in the present embodiment, description of wideband decoding apparatus 700 will be omitted for avoiding repetition.

Accordingly, with the present embodiment, a quantized wideband LSP of a previous frame is used when a wideband LSP of speech signals is predicted from a quantized narrowband LSP in wideband coding apparatus 600 and wideband decoding apparatus 700 so that it is therefore possible to improve prediction performance in band scaleable encoding and decoding of speech signals by effectively utilizing correlation between frames and correlation between frames.

In the present embodiment also as in Embodiment 1, the internal configuration of non-linear prediction section 102 may be configured as shown in FIG. 4 and FIG. 5. Moreover, the present embodiment may have a multimode configuration that performs classification of the converted wideband LSP using information obtained inside non-linear prediction section 102 and switches at least either one of LSP prediction residual codebook 110 and prediction coefficient table 631 according to divided classes.

(Embodiment 3)

Figure 8:
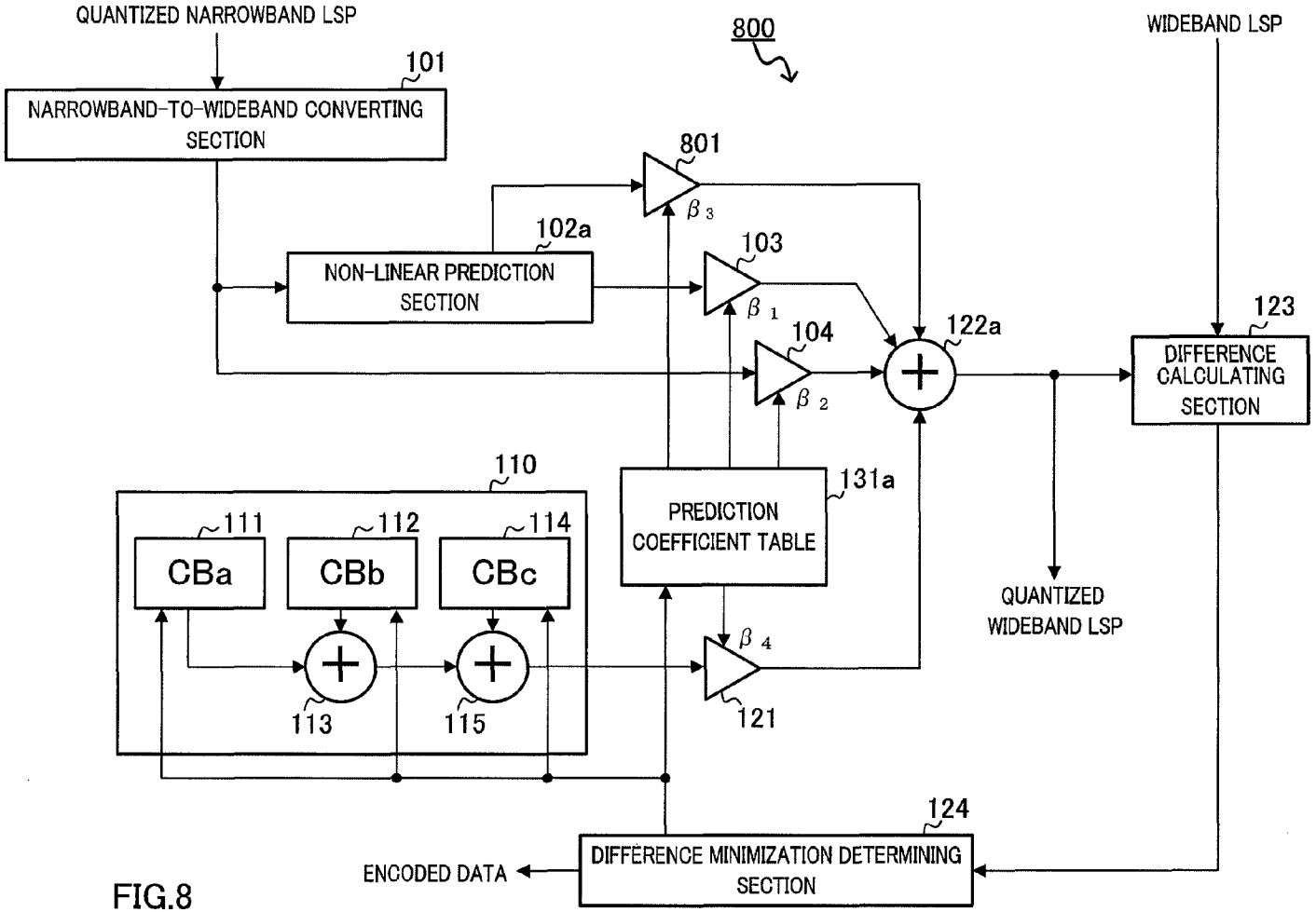
FIG. 8 is a block diagram showing main components of a wideband coding apparatus according to Embodiment 3.

FIG. 8 is a block diagram showing the main components of wideband coding apparatus 800 having a wideband LSP prediction apparatus according to Embodiment 3 of the present invention. Wideband coding apparatus 800 may further have amplifier 801 in wideband coding apparatus 100 according to Embodiment 1. Further, non-linear prediction section 102, adder 122 and prediction coefficient table 131 that have the same basic operations but perform new operations are shown as non-linear prediction section 102*a*, adder 122*a* and prediction coefficient table 131*a*. Thus, wideband coding apparatus 800 has a large number of components performing the same operation in wideband coding apparatus 100, therefore, components of wideband coding apparatus 800 different from wideband coding apparatus 100 will be described for avoiding repetition.

Non-linear prediction section 102*a* also inputs the non-linear prediction result to amplifier 801 as described later.

Prediction coefficient table 131*a* stores a plurality of prediction coefficient sets that are combinations of weighting coefficients to be reported to amplifiers 103, 104, 121 and 801, selects one reported set from among the stored prediction coefficient sets in accordance with a report from difference minimization determining section 124, and instructs to amplifiers 103, 104, 121 and 801 to use the weighting coefficients included in selected prediction coefficient set.

Amplifier 801 multiplies the non-linear prediction result inputted from non-linear prediction section 102*a* with weighting coefficient $\beta_3$ reported from prediction coefficient table 131*a*, and inputs these multiplication result to adder 122*a*.

Adder 122*a* adds multiplication results (vectors) inputted respectively from amplifiers 103, 104, 121 and 801, and outputs the addition result, i.e. the prediction result of a wideband LSP of an speech signal.

Although in the present embodiment, for easy description, the symbols representing weighting coefficients are exactly the same as in Embodiment 1 but these values are determined in an optimized manner at design stages and the actual values are therefore different from those used in Embodiment 1.

Figure 9:
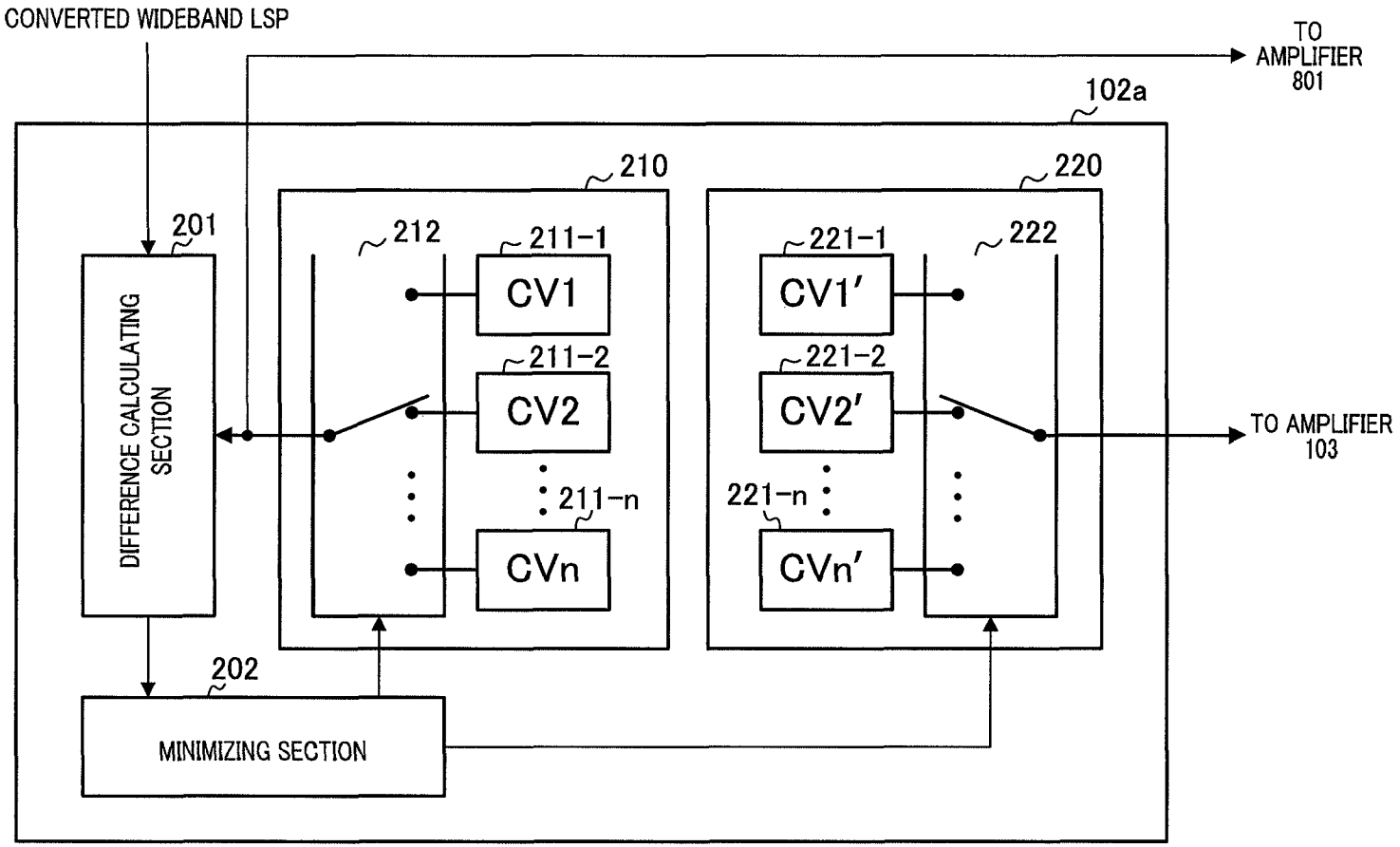
FIG. 9 is a block diagram showing the main internal configuration of a non-linear prediction section in Embodiment 3.

FIG. 9 is a block diagram showing a main internal configuration of non-linear prediction section 102*a* according to the present embodiment.

Non-linear prediction section 102 according to Embodiment 1 selects the code vector most similar to the converted wideband LSP inputted from narrowband-to-wideband converting section 101 from classification codebook 210, and outputs the code vector in wideband codebook 220 corresponding to the code vector to amplifier 103. In contrast to this, non-linear prediction section 102*a* according to the present embodiment outputs the code vector finally selected in classification codebook 210 to amplifier 801.

Figure 10:
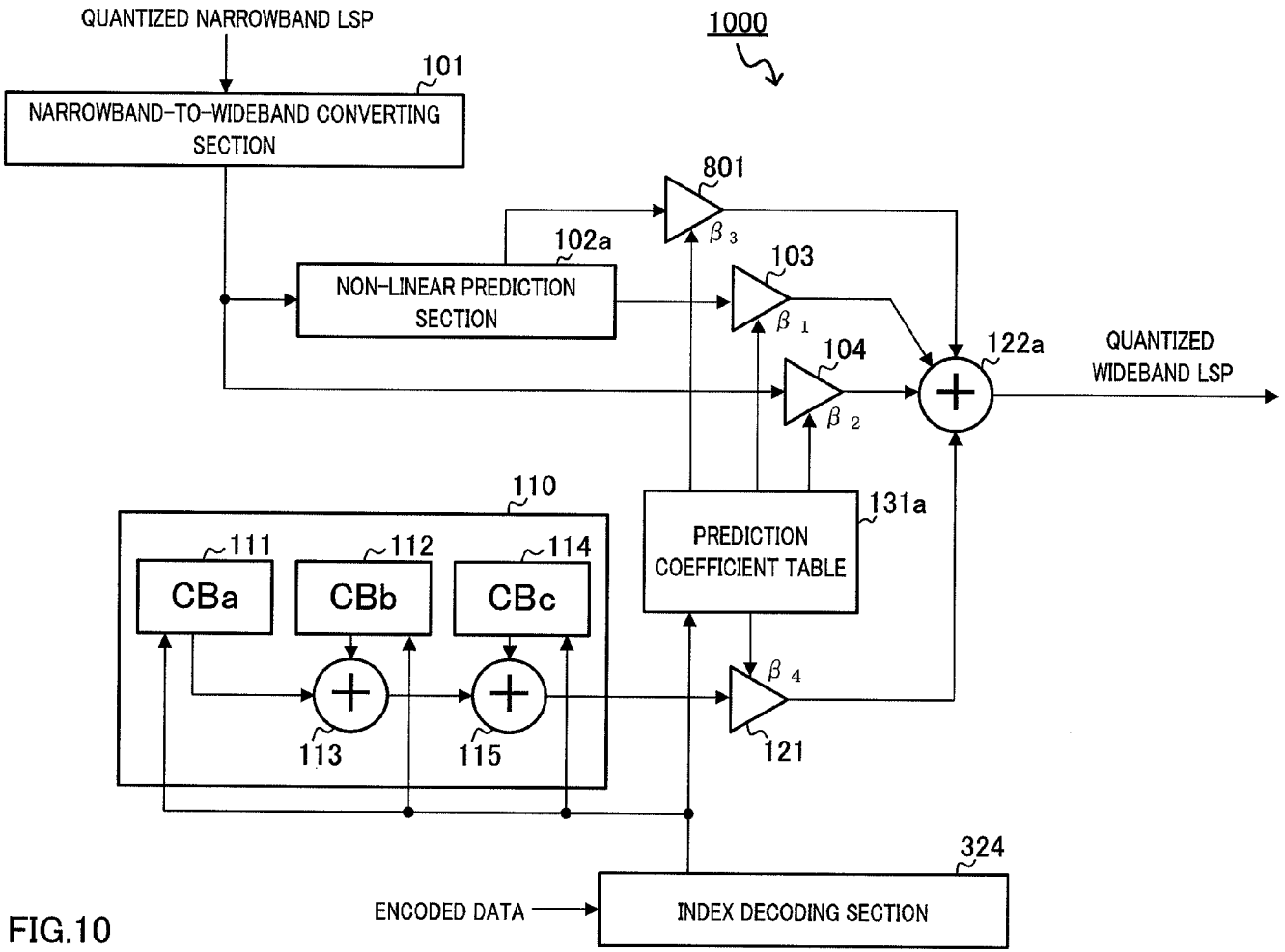
FIG. 10 is a block diagram showing main components of a wideband decoding apparatus according to Embodiment 3.

FIG. 10 is a block diagram showing the main components of wideband decoding apparatus 1000 having a wideband LSP prediction apparatus according to the present embodiment. Wideband decoding apparatus 1000 employs the same, basic configuration as wideband decoding apparatus 300 of Embodiment 1, and such as amplifier 801 has already been described, and further description of wideband decoding apparatus 1000 is omitted here.

According to the present embodiment, prediction result of the wideband LSP of speech signals is substantially using the weighted sum of the three LSPs, namely a converted wideband LSP that is substantially a narrowband LSP, a wideband LSP (non-linear predicted wideband LSP) after codebook mapping, and a converted wideband LSP vector-quantized using a code mapping codebook. Namely, a predicted wideband LSP for predicting a wideband LSP of a speech signal is represented by the following equation 2.

$$\text{Predicted wideband LSP}=\beta_2\times\text{narrowband LSP}+\beta_1\times\text{non-linear predicted wideband LSP}+3\times\text{narrowband LSP vector-quantized using a codebook mapping codebook} \quad \text{(Equation 2)}$$

On the other hand, in Embodiment 1, a narrowband LSP is converted to a wideband LSP using codebook mapping and a weighted sum for the LSPs before and after conversion is taken as the prediction result of a wideband LSP so that the predicted wideband LSP is therefore represented by equation 3 as follows.

$$\text{Predicted wideband LSP}=\beta_2\times\text{narrowband LSP}+\beta_1\times\text{non-linear predicted wideband LSP} \quad \text{(Equation 3)}$$

As a result, as compared with Embodiment 1, a narrowband LSP vector-quantized using a codebook mapping codebook is further taken into consideration so that it is possible to further increase prediction performance and encoding performance.

Figure 11:
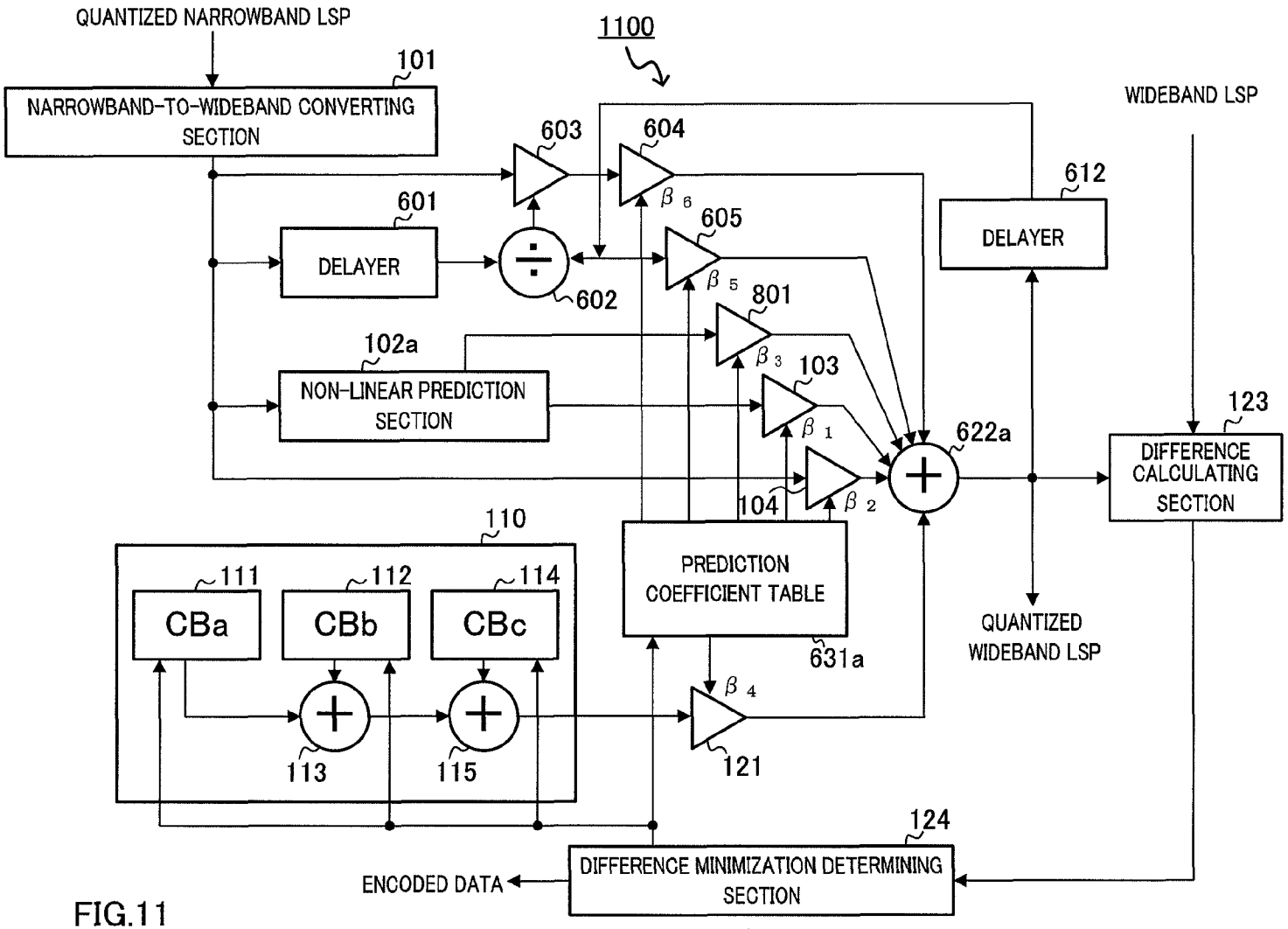
FIG. 11 is a block diagram showing main components of a wideband coding apparatus according to Embodiment 3.
Figure 12:
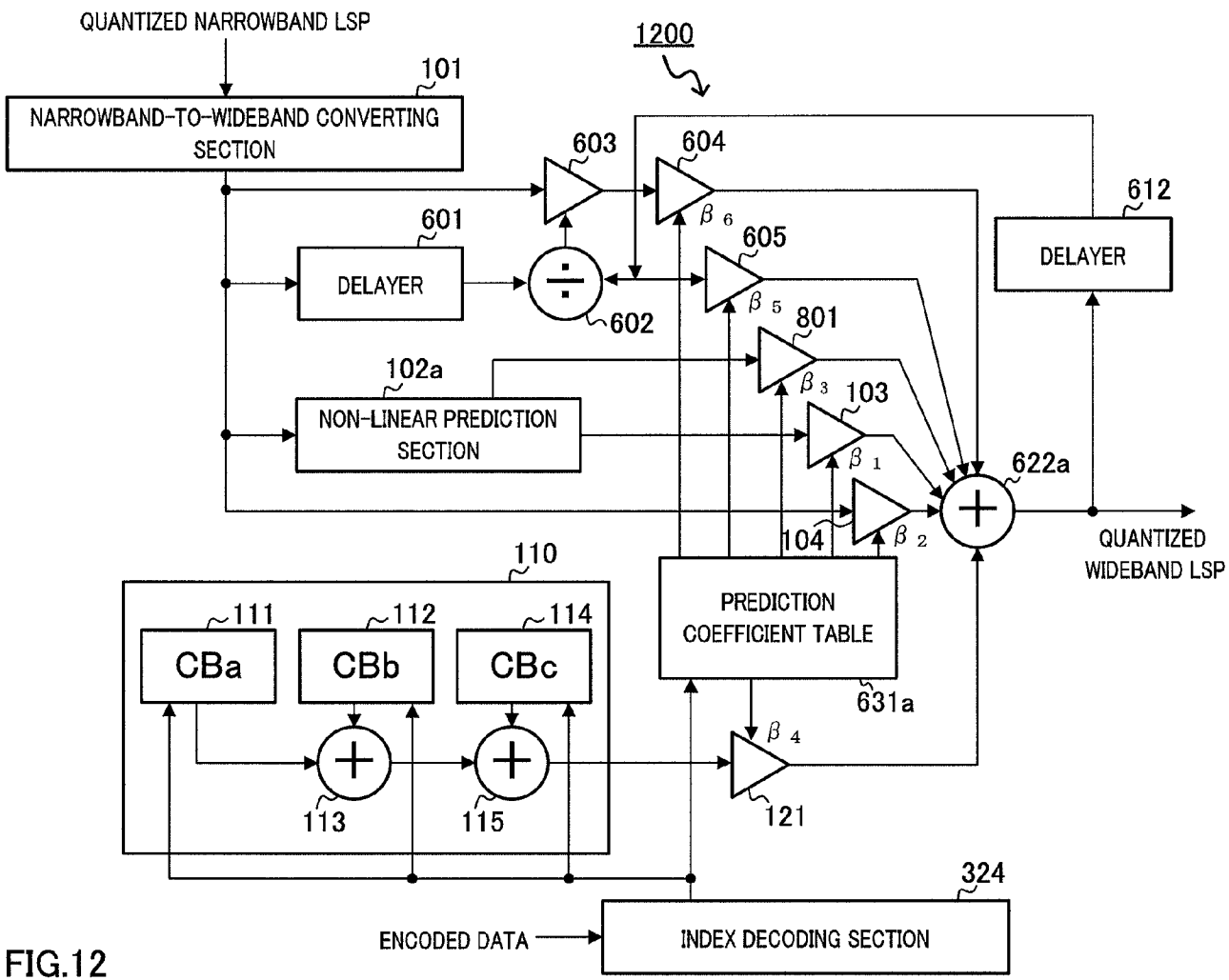
FIG. 12 is a block diagram showing main components of a wideband decoding apparatus according to Embodiment 3.

The present embodiment can also be combined with Embodiment 2. FIG. 11 and FIG. 12 are block diagrams showing main components of wideband coding apparatus 1100 and wideband decoding apparatus 1200 when the present embodiment is combined with Embodiment 2. Description of wideband coding apparatus 1100 and wideband decoding apparatus 1200 will be omitted since the basic operations have already been described.

(Embodiment 4)

Weighting coefficients multiplied in amplifiers shown in Embodiment 3 are not always positive numbers. For example, when the optimum values of coefficients are calculated using simulation and, $\beta_1$ is a positive number, $\beta_3$ often becomes a negative value close to $-\beta_1$ and $\beta_2$ often becomes values close to 1.0.

Under these conditions, above equation 2 provides a predicted wideband LSP by adding weighting differences between a narrowband LSP inputted by narrowband-to-wideband converting section 101 and code vectors stored in narrowband codebooks to code vectors outputted from a wideband codebook. At this time, all of non-linear prediction section 102*a*, amplifier 801, and adder 122*a* shown in Embodiment 3 can be taken as one non-linear prediction section 102*b*.

Figure 13:
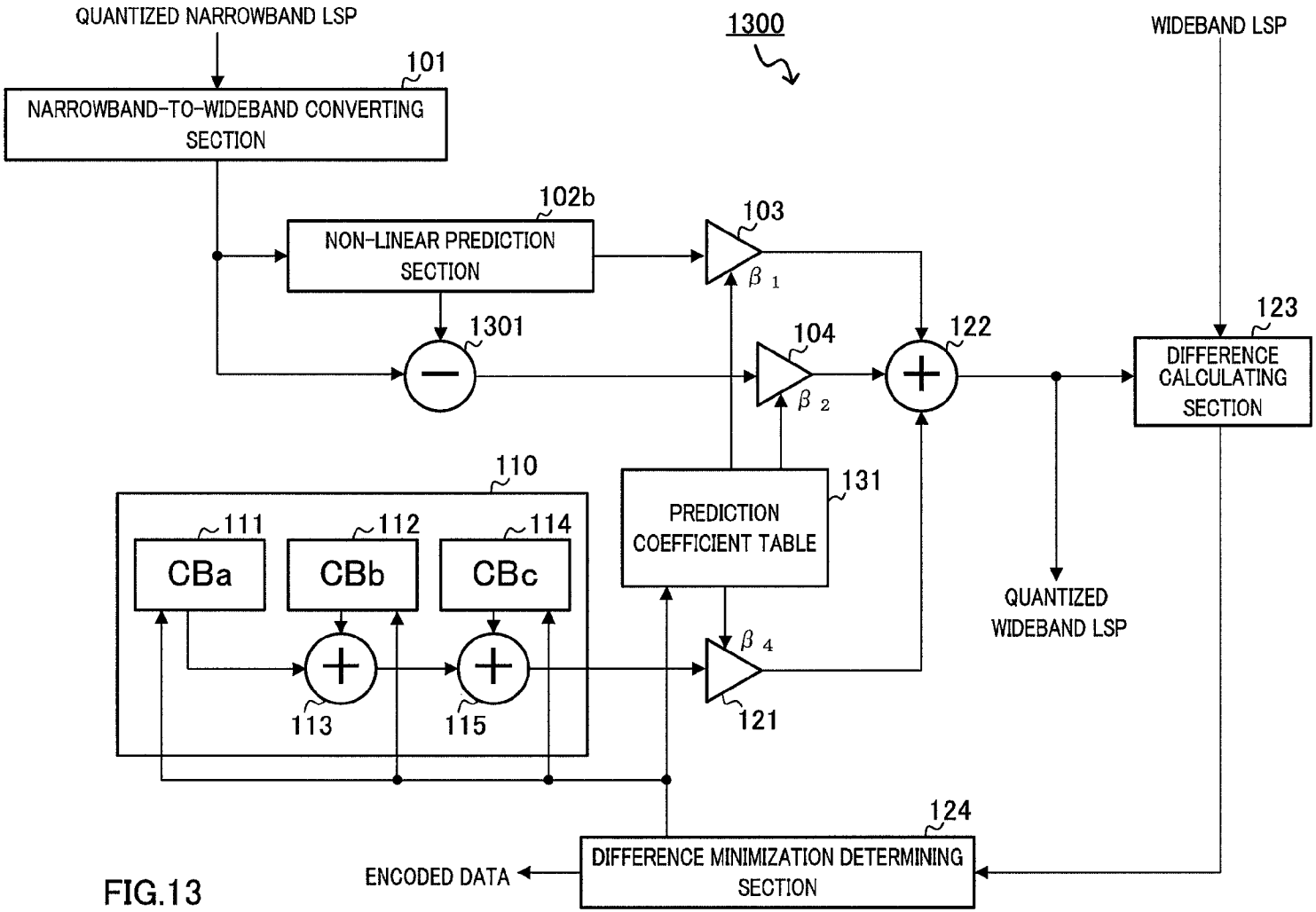
FIG. 13 is a block diagram showing main components of a wideband coding apparatus according to Embodiment 4.

FIG. 13 is a block diagram showing the main components of wideband coding apparatus 1300 having a wideband LSP prediction apparatus according to Embodiment 4 of the present invention. Wideband coding apparatus 1300 also has a large number of the components performing the same operation as in wideband coding apparatus 100 according to Embodiment 1.

According to this configuration, where $\beta_3=-\beta_1$, predicted wideband LSP can be calculated as shown in the following equation 4 by calculating the difference between the narrow band LSP and the narrowband LSP vector-quantized using a codebook mapping codebook and subtractor 1301.

Predicted wideband LSP=$\beta_1$×non-linear predicted wideband LSP+$\beta_2$×(narrowband LSP−narrowband LSP vector-quantized using a codebook mapping codebook) (Equation 4)

Figure 14:
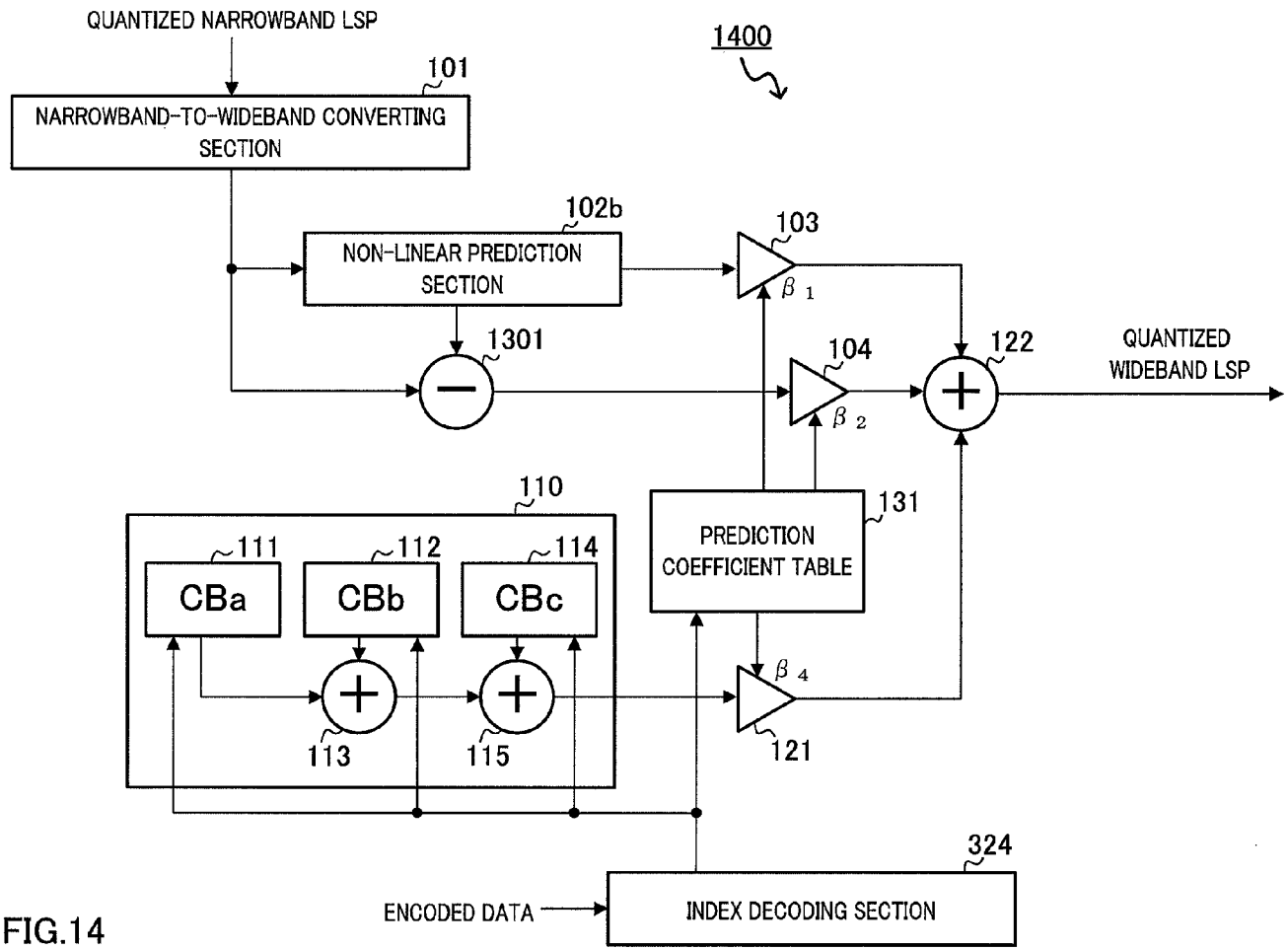
FIG. 14 is a block diagram showing main components of a wideband decoding apparatus according to Embodiment 4.

FIG. 14 is a block diagram showing the main components of wideband decoding apparatus 1400 having a wideband LSP prediction apparatus according to the present embodiment. The basic operation has already been described, therefore, description of wideband decoding apparatus 1400 will be omitted.

According to the present embodiment, it is possible to reduce one of prediction coefficients (weighting coefficients) and save the amount of memory for this reduction by using the prediction model of above equation 4.

Figure 15:
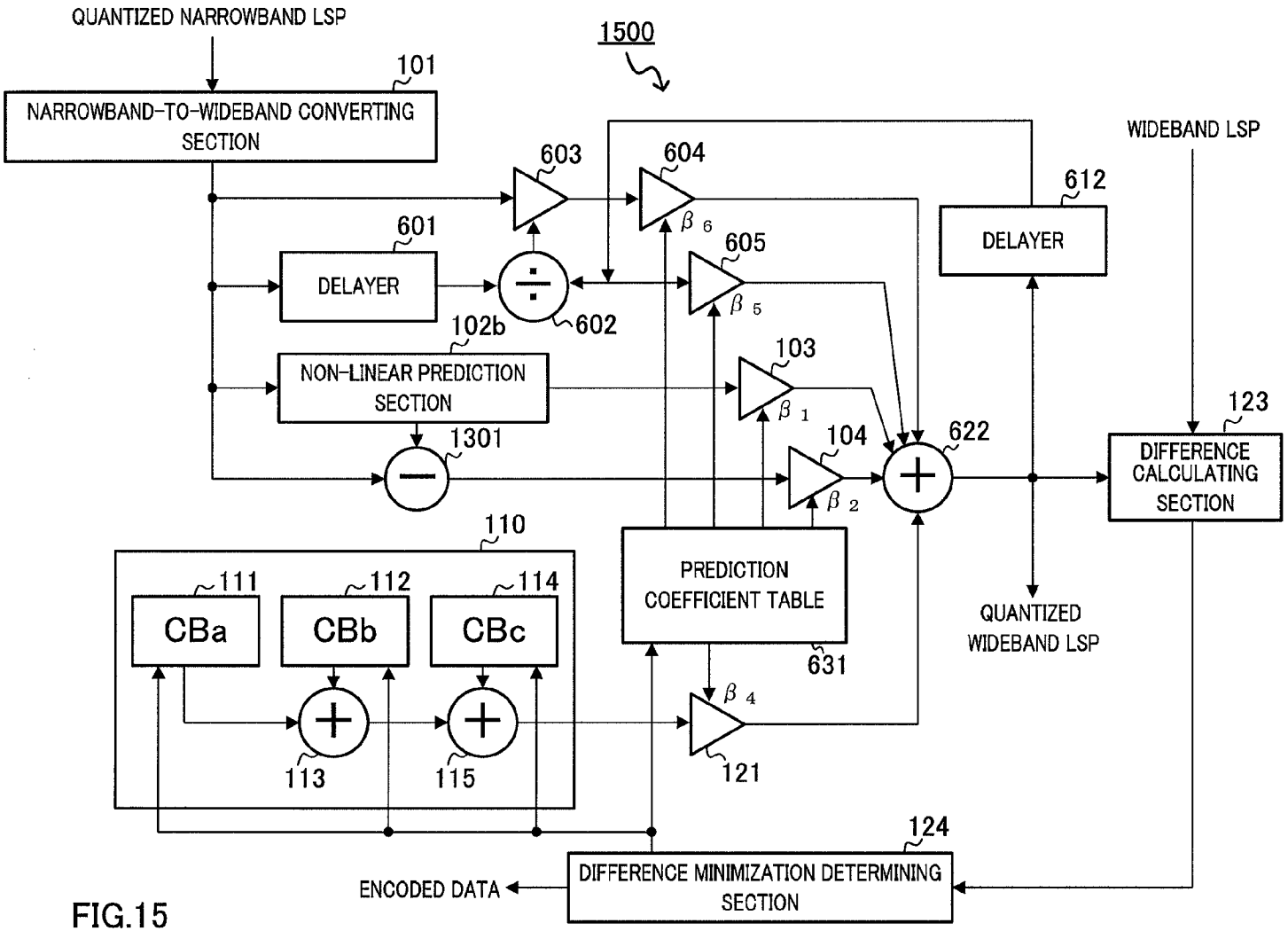
FIG. 15 is a block diagram showing main components of a wideband coding apparatus according to Embodiment 4.
Figure 16:
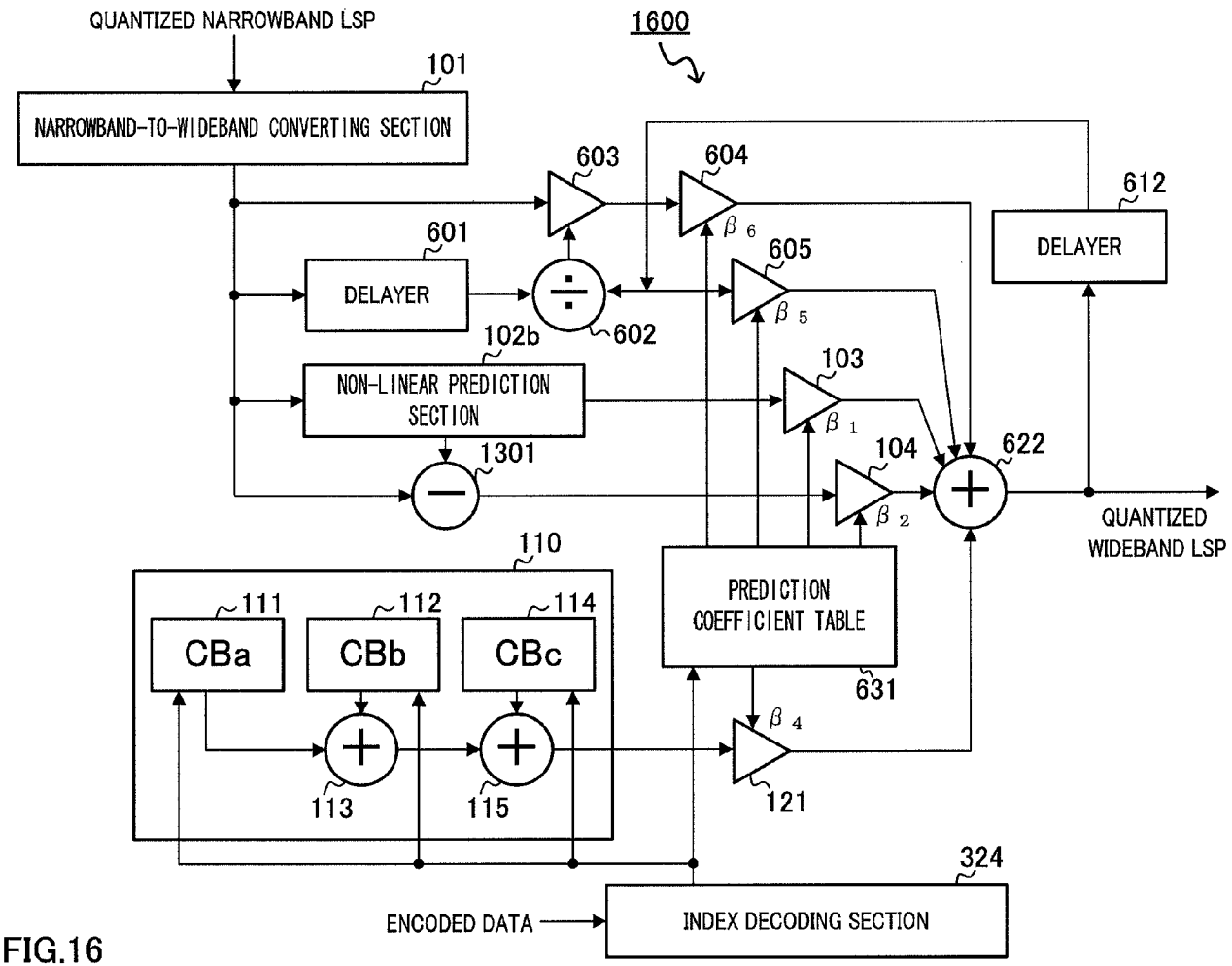
FIG. 16 is a block diagram showing main components of a wideband decoding apparatus according to Embodiment 4.

The present embodiment can also be combined with Embodiment 2. FIG. 15 and FIG. 16 are block diagrams showing main components of wideband coding apparatus 1500 and wideband decoding apparatus 1600 when the present embodiment is combined with Embodiment 2. The basic operations have also already been described, therefore, description of wideband coding apparatus 1500 wideband decoding apparatus 1600 will be omitted.

(Embodiment 5)

A wideband coding apparatus according to Embodiment 5 of the present invention has the same basic configuration as wideband coding apparatus 100 according to Embodiment 1. Therefore, non-linear prediction section 102*c* that has a different configuration from the one in Embodiment 1 will be described.

Figure 17:
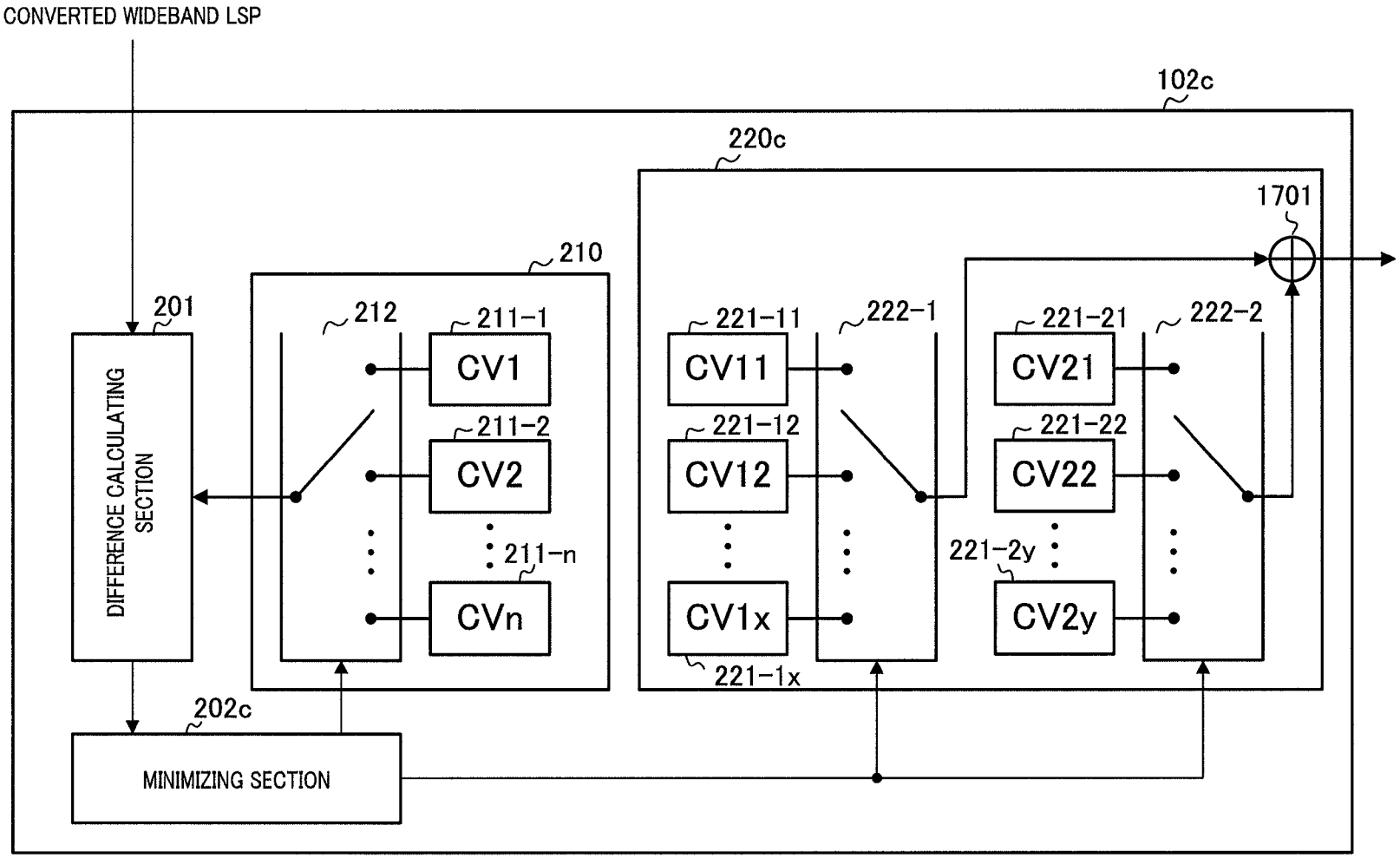
FIG. 17 is a block diagram showing the main internal configuration of a non-linear prediction section in Embodiment 5.

FIG. 17 is a block diagram showing a main internal configuration of non-linear prediction section 102*c*.

Non-linear prediction section 102*c* has a multi-stage configuration of wideband codebook 220 (refer to FIG. 2) described in Embodiment 1. Namely, wideband codebook 220*c* according to the present embodiment has a multi-stage configuration. The example shown in FIG. 17 has a two-stage configuration. Here, x represents the number of code vectors stored by first-stage codebooks 221-11 to 221-1x of wideband codebook 220*c* and y represents the number of code vectors stored in second-stage codebooks 221-21 to 221-2y of wideband codebook 220*c*, where the relationship n=x×y holds.

The association of classification code vectors CVk of classification codebook 210 with wideband code vectors CVk' generated from wideband codebook 220*c* may be, for example, designed in advance as follows. Here, a case will be described where x=8, y=8 and n=64.

$$CV1 \rightarrow CV11 + CV21$$

$$CV2 \rightarrow CV11 + CV22$$

$$\vdots$$

$$CV8 \rightarrow CV11 + CV28$$

$$CV9 \rightarrow CV12 + CV21$$

$$\vdots$$

$$CV16 \rightarrow CV12 + CV28$$

$$CV17 \rightarrow CV13 + CV21$$

$$\vdots$$

$$CV64 \rightarrow CV18 + CV28$$

If classification code vectors CVk and wideband code vectors CVk' are associated as described above, three bits from the top of the code vector index selected from classification codebook 210 become the code vector number selected from first-stage codebooks 221-11 to 221-1x of wideband codebook 220*c* and three bits from the bottom of the code vector index selected from classification codebook 210 become the code vector number selected from the second-stage codebook 221-21 to 221-2y of wideband codebook 220*c*. It is therefore not necessary to keep the association of classification code vectors CVk with wideband code vectors CVk' in a separate memory.

In this way, according to the present embodiment, at least either one of classification codebook 210 or wideband codebook 220 has a multi-stage configuration, therefore, it is possible to reduce the amount of memory required in non-linear prediction processing.

In the present embodiment 1, it is also possible to provide a multi-stage configuration with classification codebook 210 rather than wideband codebook 220. However, when the vector dimensions of wideband codebook 220 are greater than those of classification codebook 210, the reduction of memory will be greater by providing wideband codebook 220 with multi-stages.

Figure 18:
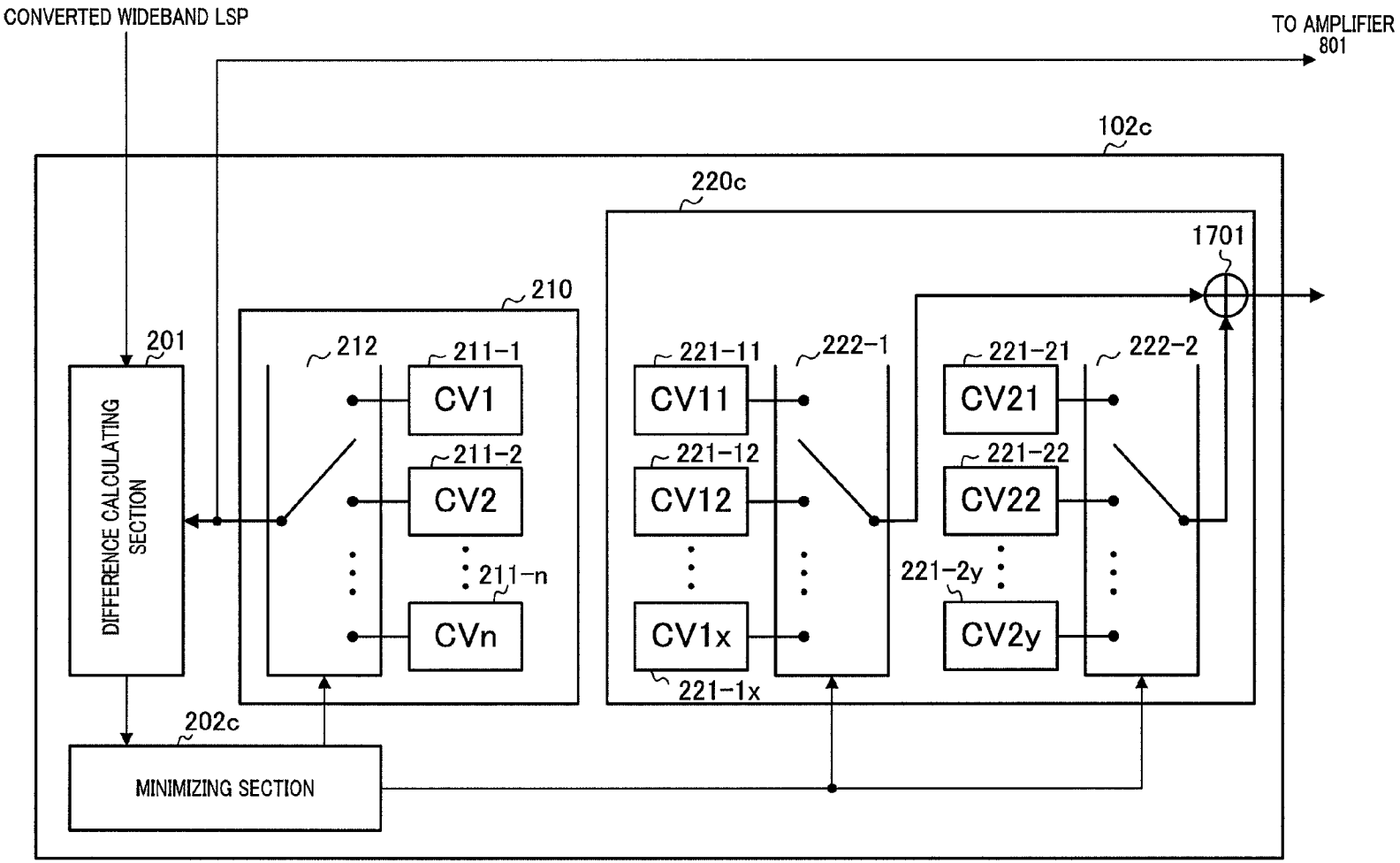
FIG. 18 is a view showing variation of a non-linear prediction section in Embodiment 5.

Further, it is possible to apply the present embodiment to Embodiment 3 and Embodiment 4. In this case, non-linear prediction section 102*a* described in Embodiment 3 becomes non-linear prediction section 102*c* shown in FIG. 18.

(Embodiment 6)

Figure 19:
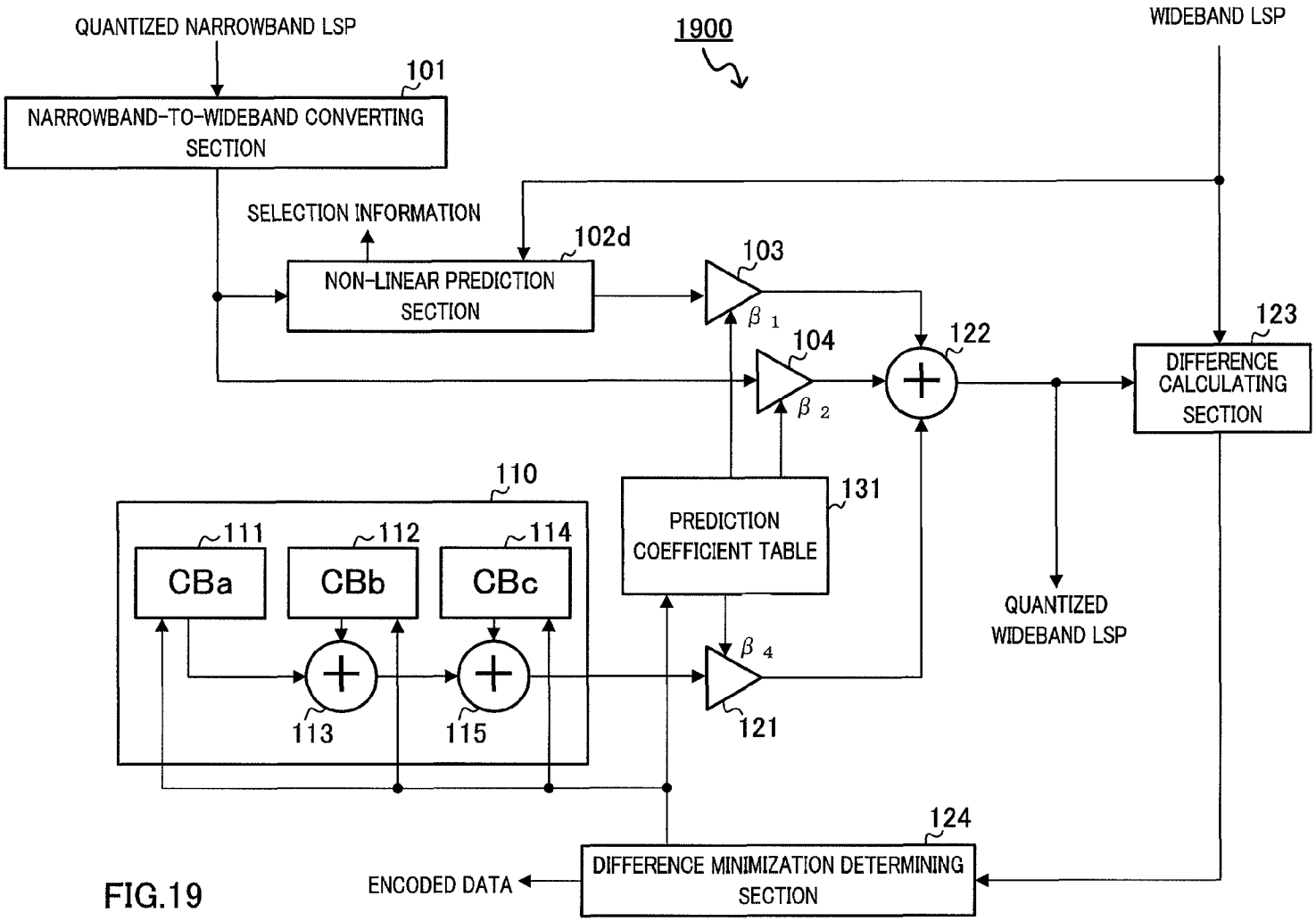
FIG. 19 is a block diagram showing main components of a wideband coding apparatus according to Embodiment 6.

FIG. 19 is a block diagram showing the main components of wideband coding apparatus 1900 according to Embodiment 6 of the present invention. Wideband coding apparatus 1900 has a large number of the components performing the same operations as in wideband coding apparatus 100 according to Embodiment 1, therefore, in the present embodiment, components of wideband coding apparatus 1900 different from wideband coding apparatus 100 will be described for avoiding repetition.

Wideband coding apparatus 1900 selects codebook mapping candidates and outputs information related to these selections to a wideband decoding apparatus. To be more specific, wideband coding apparatus 1900 selects a plurality of candidate code vectors from a classification codebook, selects a code vector minimizes the di from inputted wideband LSP vectors from these vectors, and transmits this selected information to a wideband decoding apparatus together with the encoded data.

Figure 20:
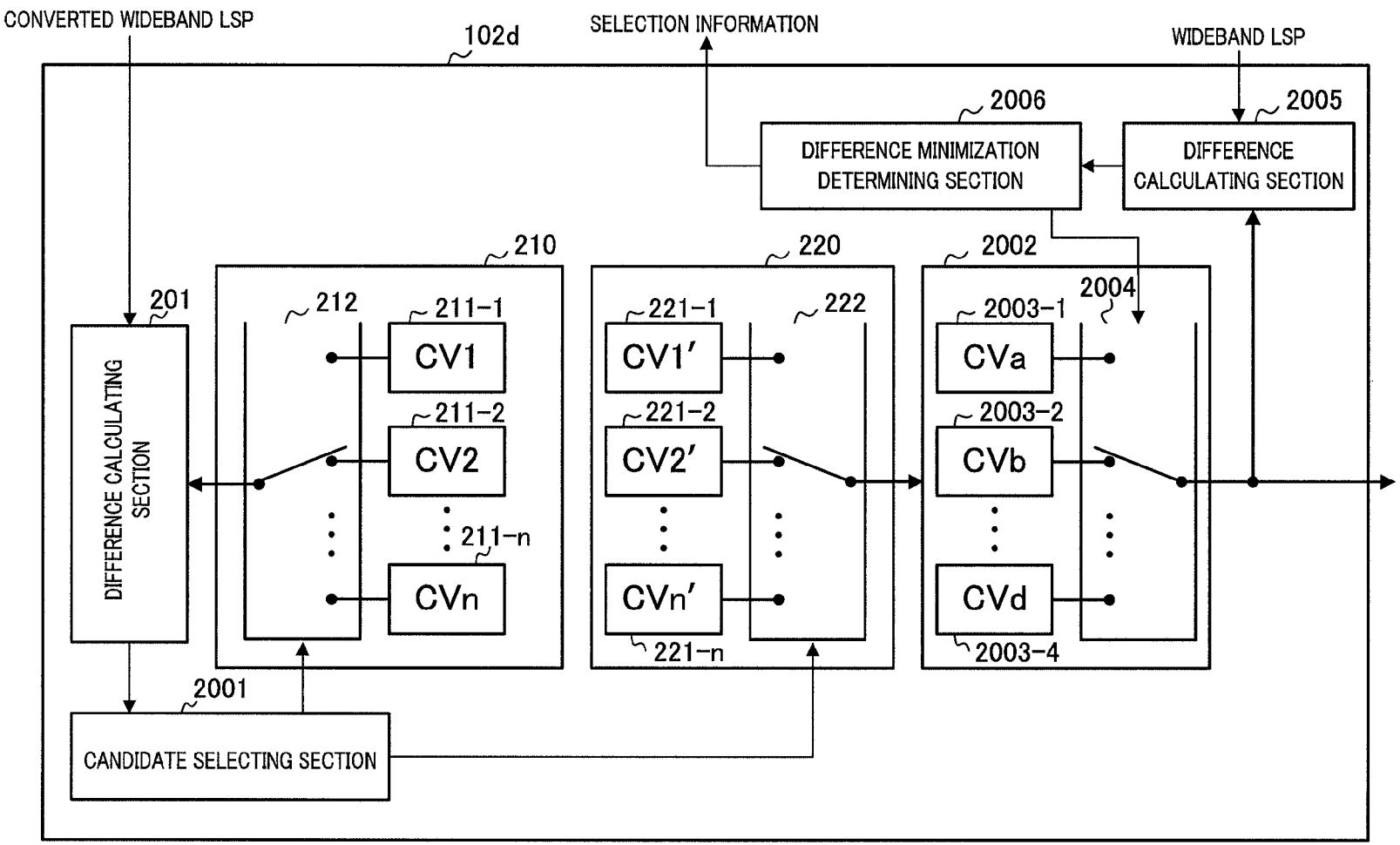
FIG. 20 is a block diagram showing the main internal configuration of a non-linear prediction section in Embodiment 6.

FIG. 20 is a block diagram showing a main internal configuration of non-linear prediction section 102*d*.

As with minimizing section 202 described in Embodiment 1, candidate selecting section 2001 selects one classification code vector that minimizes the square difference. Further, candidate selecting section 2001 selects a plurality of classification code vectors (candidate code vectors) in order from smaller square differences, and instructs to wideband codebook 220 to output a plurality of code vectors respectively corresponding to a plurality of selected candidate code vectors. FIG. 20 shows an example when the number of candidates is 4. In the following description, the number of candidates is 4.

Wideband codebook 220 outputs four wideband code vectors specified by candidate selecting section 2001 to candidate code vector codebook 2002.

Candidate code vector codebook 2002 stores a plurality of inputted wideband code vectors in candidate code vector storage sections CVa to CVd. At this time, four wideband code vectors are stored in CVa, CVb, CVc and CVd in order from smaller differences calculated in difference calculating section 201. The four wideband code vectors are then outputted one by one to difference calculating section 2005 in accordance with the designation from difference minimization determining section 2006.

Difference calculating section 2005 calculates differences between the inputted wideband LSP and wideband code vectors in the same manner as in difference calculating section 201 and outputs the result to difference minimization determining section 2006.

Difference minimization determining section 2006 obtains a wideband code vector that minimizes the difference from inputted wideband LSP vectors using feedback control from a plurality of wideband code vectors stored in candidate code vector codebook 2002. To be more specific, as with minimizing section 202 described in Embodiment 1, difference minimization determining section 2006 selects one code vector that minimizes the difference outputted from difference calculating section 2005 from the four wideband code vectors stored in candidate code vector codebook 2002, and instructs candidate code vector codebook 2002 to output this selected wideband code vector to amplifier 103. Further, difference minimization determining section 2006 also outputs information (selection information) related to this selected wideband code vector.

Figure 21:
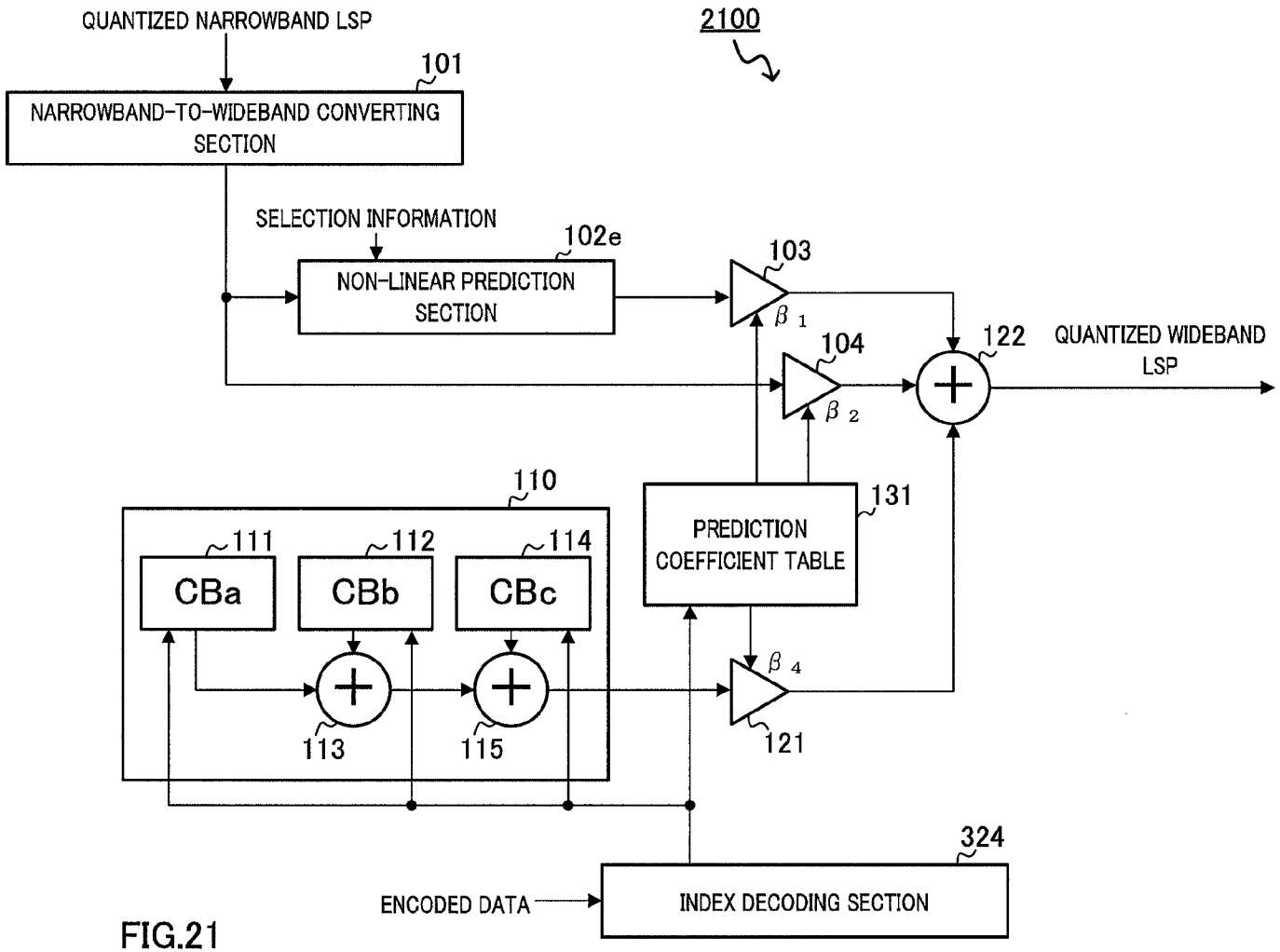
FIG. 21 is a block diagram showing main components of a wideband decoding apparatus according to Embodiment 6.

FIG. 21 is a block diagram showing the main components of wideband decoding apparatus 2100 for decoding encoded data and selection information generated by wideband coding apparatus 1900 according to the present embodiment. Wideband decoding apparatus 2100 has a large number of components performing the same operations as in wideband decoding apparatus 300 according to Embodiment 1, therefore, components of wideband decoding apparatus 2100 different from wideband decoding apparatus 300 will be described for avoiding repetition.

Figure 22:
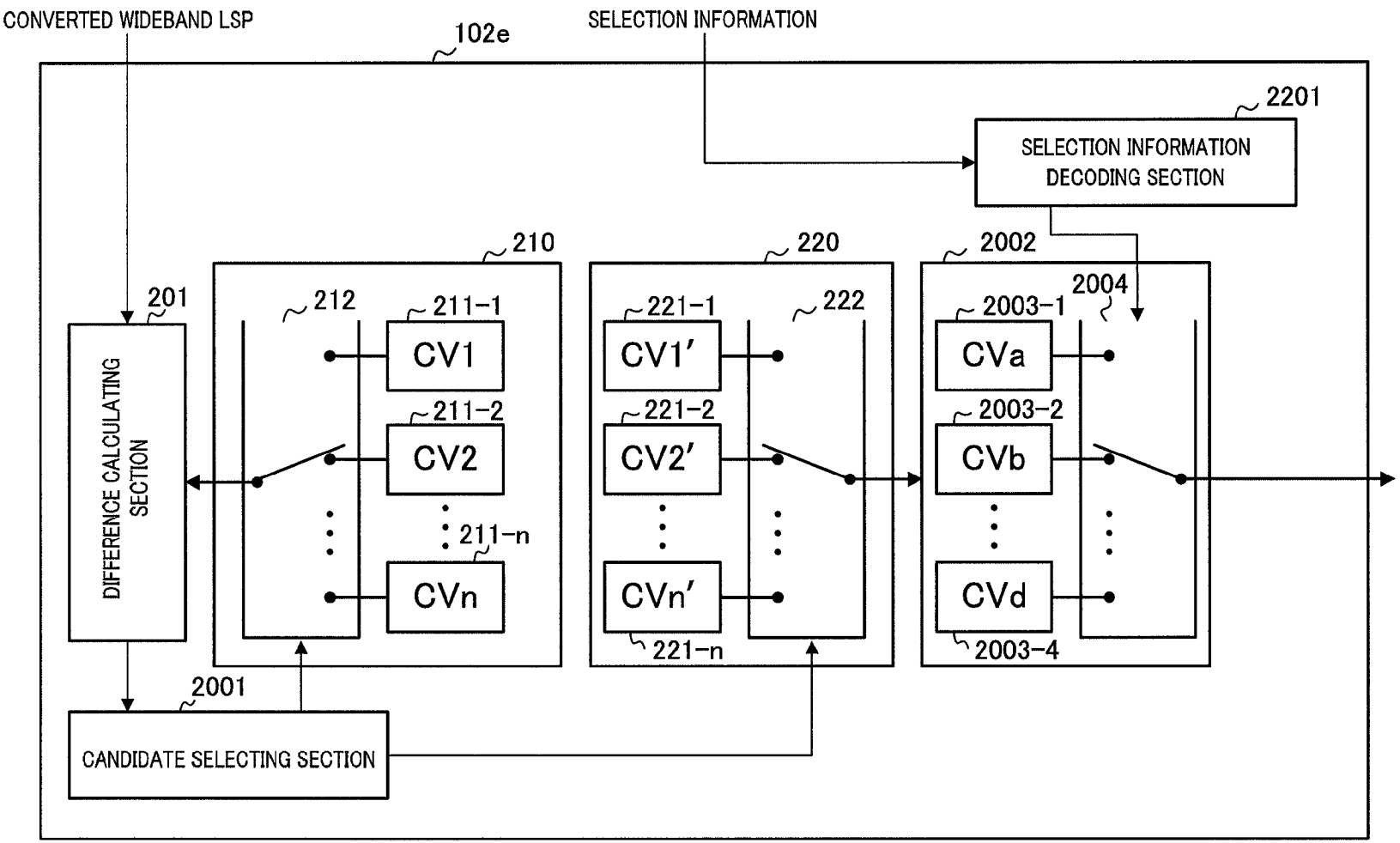
FIG. 22 is a block diagram showing the main internal configuration of a non-linear prediction section in Embodiment 6.

Non-linear prediction section 102*e* is inputted with selection information transmitted from above non-linear prediction section 102*d* and outputs non-linear prediction results based on this selection information to amplifier 103. FIG. 22 is a block diagram showing a main internal configuration for non-linear prediction section 102*e*.

Non-linear prediction section 102*e* has the same configuration as non-linear prediction section 102*d* other than selection information decoding section 2201, therefore, the same components are not described here. Selection information decoding section 2201 decodes inputted selection information and instructs candidate code vector codebook 2002 to output code vectors specified by this selection information.

In this way, according to the present embodiment, a plurality of candidates are selected from a classification codebook and a code vector that minimizes prediction differences and quantization differences is selected from a plurality of candidates so that it is possible to improve prediction accuracy of non-linear prediction.

Non-linear prediction sections 102*d* and 102*e* according to the present embodiment may also be applied to Embodiment 3 and Embodiment 4.

(Embodiment 7)

Figure 23:
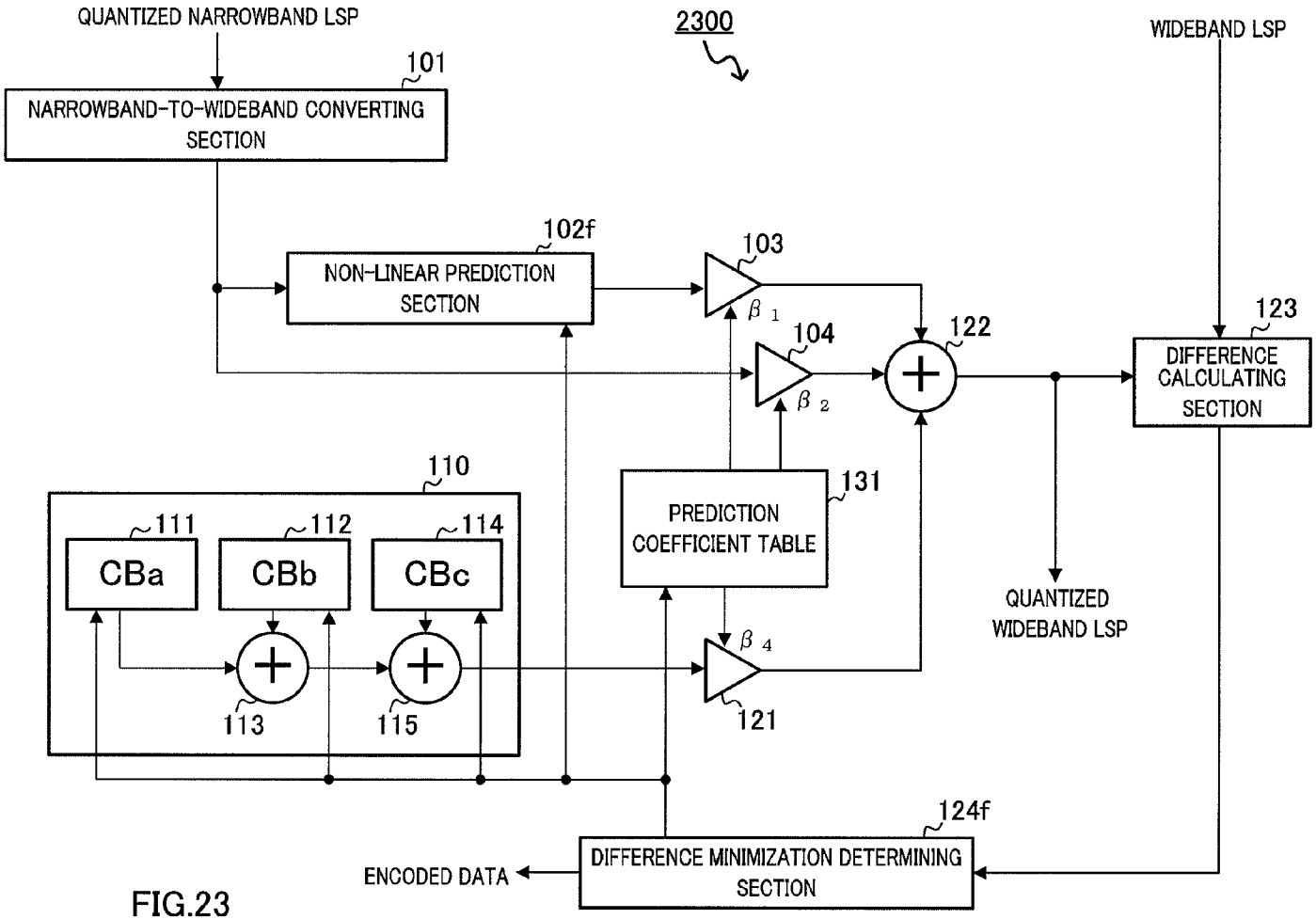
FIG. 23 is a block diagram showing main components of a wideband coding apparatus according to Embodiment 7.

FIG. 23 is a block diagram showing the main components of wideband coding apparatus 2300 according to Embodiment 7 of the present invention. As with Embodiment 6, wideband coding apparatus 2300 has a large number of components performing the same operations as in wideband coding apparatus 100 according to Embodiment 1, therefore, components of wideband coding apparatus 2300 different from wideband coding apparatus 100 will be described for avoiding repetition.

The present embodiment differs from Embodiment 6 in that non-linear prediction section 102*f* selects codebook mapping candidates using quantization results (output of difference minimizing determining section 124*f*). As a result, difference minimization determining section 124*f* outside non-linear prediction section 102*f* performs feedback control for minimizing the difference from the wideband LSP without minimizing the difference from the wideband LSP inside non-linear prediction section 102*f*.

Non-linear prediction section 102*f* sequentially outputs a predetermined number of non-linear prediction results to amplifier 103 in accordance with the designation from difference minimization determining section 124*f*. The example in FIG. 23 shows that non-linear prediction section 102*f* outputs four code vectors stored in CVa to CVd to amplifier 103 as a predetermined number of non-linear prediction results.

Difference minimization determining section 124*f* determines sets of first-stage code vectors to third-stage code vectors and prediction coefficients when these predetermined number of non-linear prediction results are used. Difference minimization determining section 124*f* obtains, from among these parameters, the non-linear prediction result that minimizes the difference outputted from difference calculating section 123 and outputs a set of non-linear prediction results, first-stage code vectors to third-stage code vectors determined based on the non-linear prediction results and prediction coefficients to, for example, a radio transmitting section (not shown) as encoded data.

Figure 24:
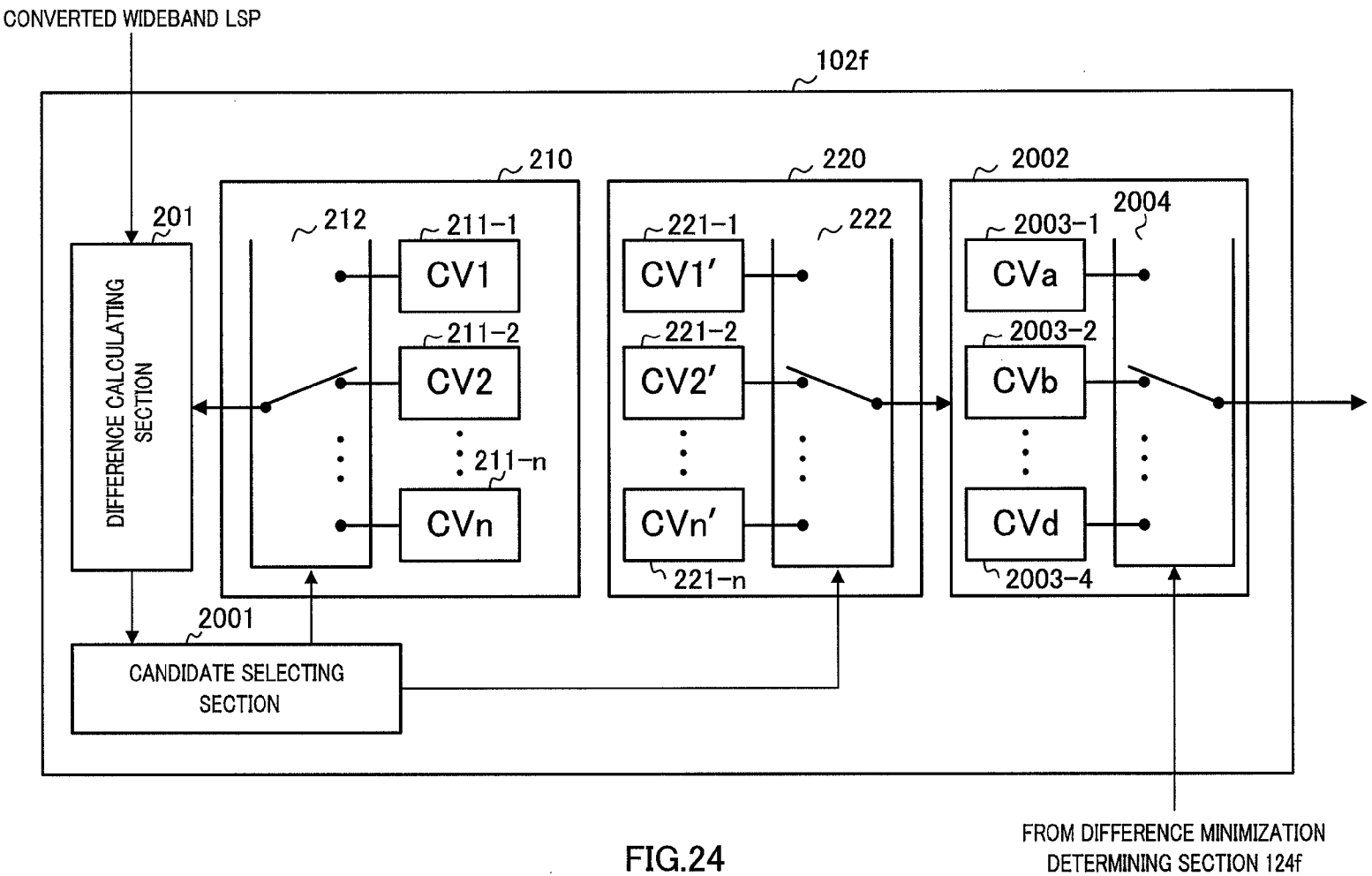
FIG. 24 is a block diagram showing the main internal configuration of a non-linear prediction section in Embodiment 7.

FIG. 24 is a block diagram showing a main internal configuration of non-linear prediction section 102*f*. The same components of non-linear prediction section 102*d* described in Embodiment 6 will not be described for avoiding repetition.

Candidate code vector codebook 2002 receives an input of designation information from difference minimization determining section 124*f*, selects and outputs one code vector based on this designation information to amplifier 103.

Figure 25:
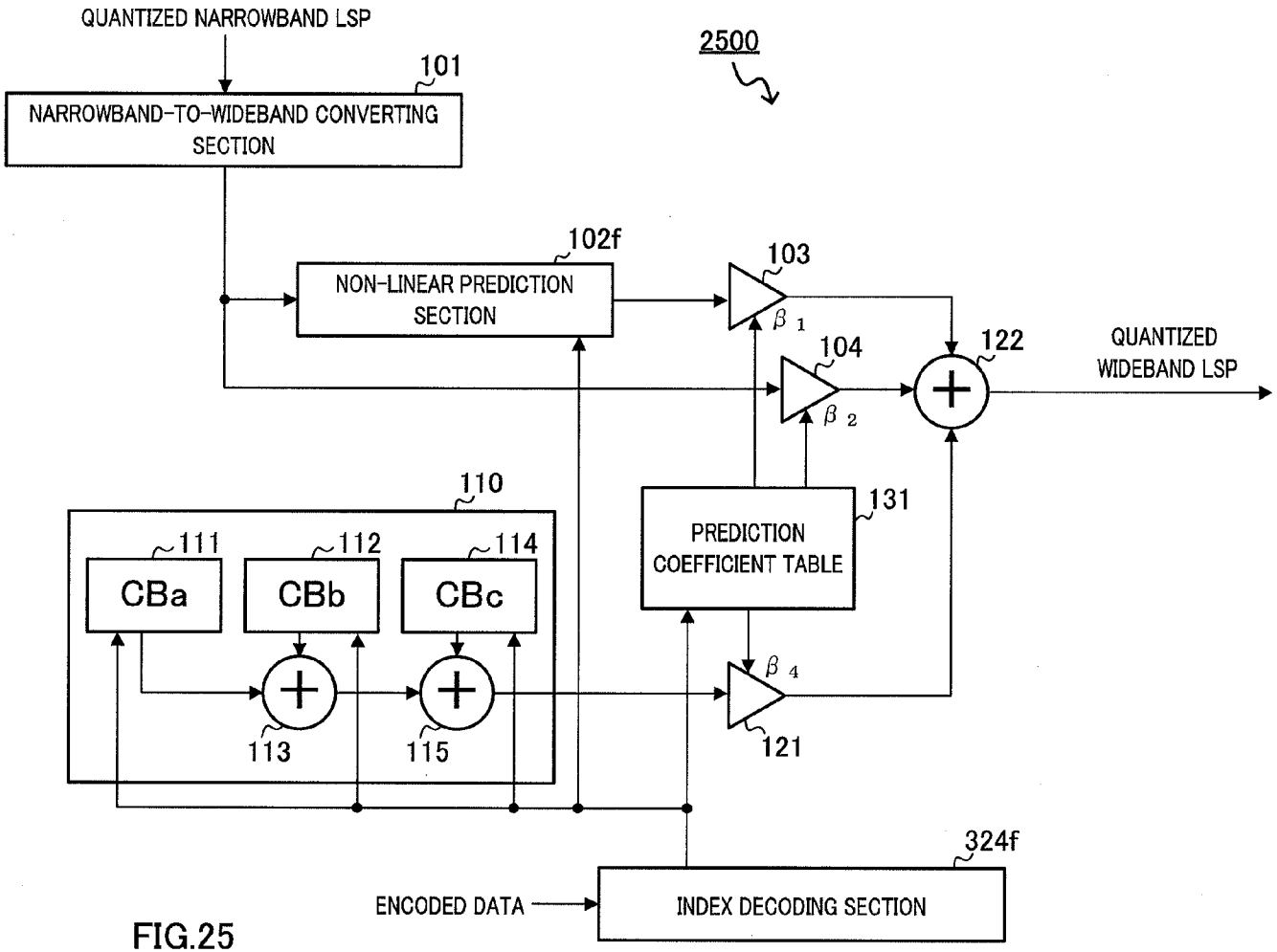
FIG. 25 is a block diagram showing main components of a wideband decoding apparatus according to Embodiment 7.

FIG. 25 is a block diagram showing the main components of wideband decoding apparatus 2500 for decoding encoded data generated by wideband coding apparatus 2300 according to the present embodiment.

In addition to information described in Embodiment 1, selection information of non-linear prediction results outputted from non-linear prediction section 102*f* is included in encoded data generated by wideband coding apparatus 2300. Here, index decoding section 324*f* decodes above selection information from inputted encoded data and inputs the results to non-linear prediction section 102*f*.

Non-linear prediction section 102*f* then outputs non-linear prediction results to amplifier 103 based on inputted selection information. The internal configuration of non-linear prediction section 102*f* provides the same configuration shown in FIG. 24.

In this way, according to the present embodiment, a plurality of candidates are selected from a classification codebook and a code vector that minimize prediction differences and quantization differences is selected from a plurality of candidates so that it is possible to improve prediction accuracy of non-linear prediction.

Non-linear prediction section 102*f*, difference minimization determining section 124*f*, and index decoding section 324*f* according to the present embodiment may also be applied to Embodiment 4.

(Embodiment 8)

Figure 26:
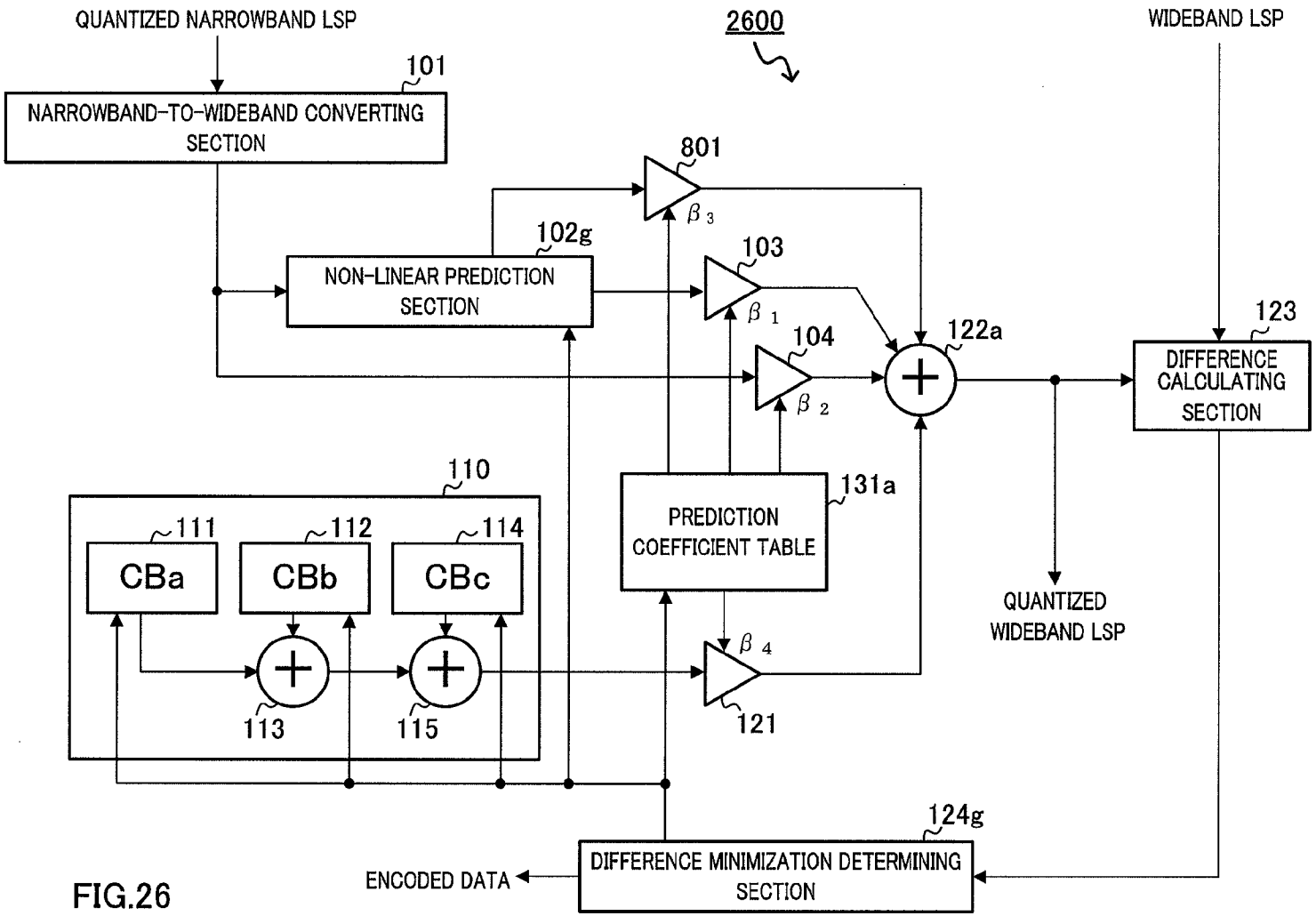
FIG. 26 is a block diagram showing main components of a wideband coding apparatus according to Embodiment 8.

FIG. 26 is a block diagram showing the main components of wideband coding apparatus 2600 according to Embodiment 8 of the present invention. Wideband coding apparatus 2600 has a large number of components performing the same operations as in wideband coding apparatus 800 (refer to FIG. 8) according to Embodiment 3, therefore, in the present embodiment, components of wideband coding apparatus 2600 different from wideband coding apparatus 800 will be described for avoiding repetition.

Non-linear prediction section 102*g* selects a plurality of candidate code vectors from a classification codebook in accordance with the designation from difference minimization determining section 124*g*, outputs code vectors of the wideband codebook corresponding to these code vectors to amplifier 103, and outputs candidate vectors themselves selected from the classification codebook to amplifier 801.

Difference minimization determining section 124*g* determines sets of first-stage code vectors to third-stage code vectors and prediction coefficients using sets of a predetermined number of wideband code vectors and classification code vectors. Difference minimization determining section 124*g* obtains a set of classification code vectors that minimize the difference outputted by difference calculating section 123 and wideband code vectors from within these parameters, generates encoded data representing first-stage code vectors to third-stage code vectors determined using this obtained set and the prediction set, and inputs the obtained set and generated encoded data to a radio transmitting section (not shown).

Figure 27:
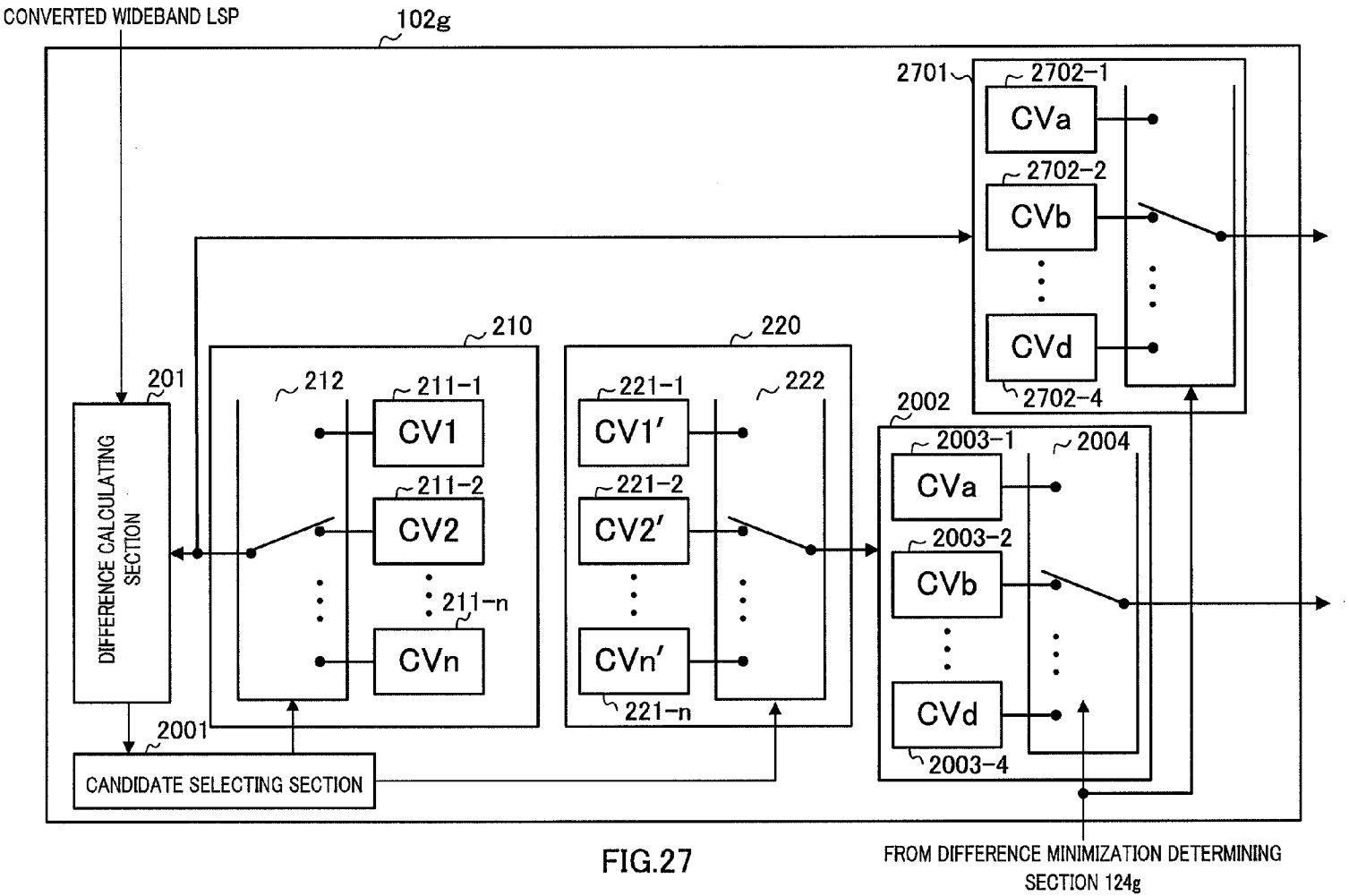
FIG. 27 is a block diagram showing the main internal configuration of a non-linear prediction section in Embodiment 8.

FIG. 27 is a block diagram showing a main internal configuration of non-linear prediction section 102*g*. Non-linear prediction section 102*g* has the same configuration as non-linear prediction section 102*f* described in Embodiment 7 and will not be described for avoiding repetition.

Non-linear prediction section 102*g* has a configuration that adds candidate code vector (classification code vector) codebook 2701 to non-linear prediction section 102*f* described in Embodiment 7. Non-linear prediction section 102*g* has the same configuration as non-linear prediction section 102*f* other than candidate code vector codebook 2701, therefore, the same components are not described here. Candidate code vector codebook 2701 selects code vectors based on designation information from difference minimization determining section 124*g* and outputs the code vectors to amplifier 801.

Non-linear prediction section 102*g* outputs non-linear prediction results (wideband code vectors) and corresponding classification code vectors to amplifier 103. The wideband code vectors and classification code vectors to be outputted are not just one type, but a predetermined number of wideband code vectors and classification code vectors are sequentially inputted to amplifier 103 and amplifier 801 in accordance with the designation from difference minimization determining section 124*g*.

Figure 28:
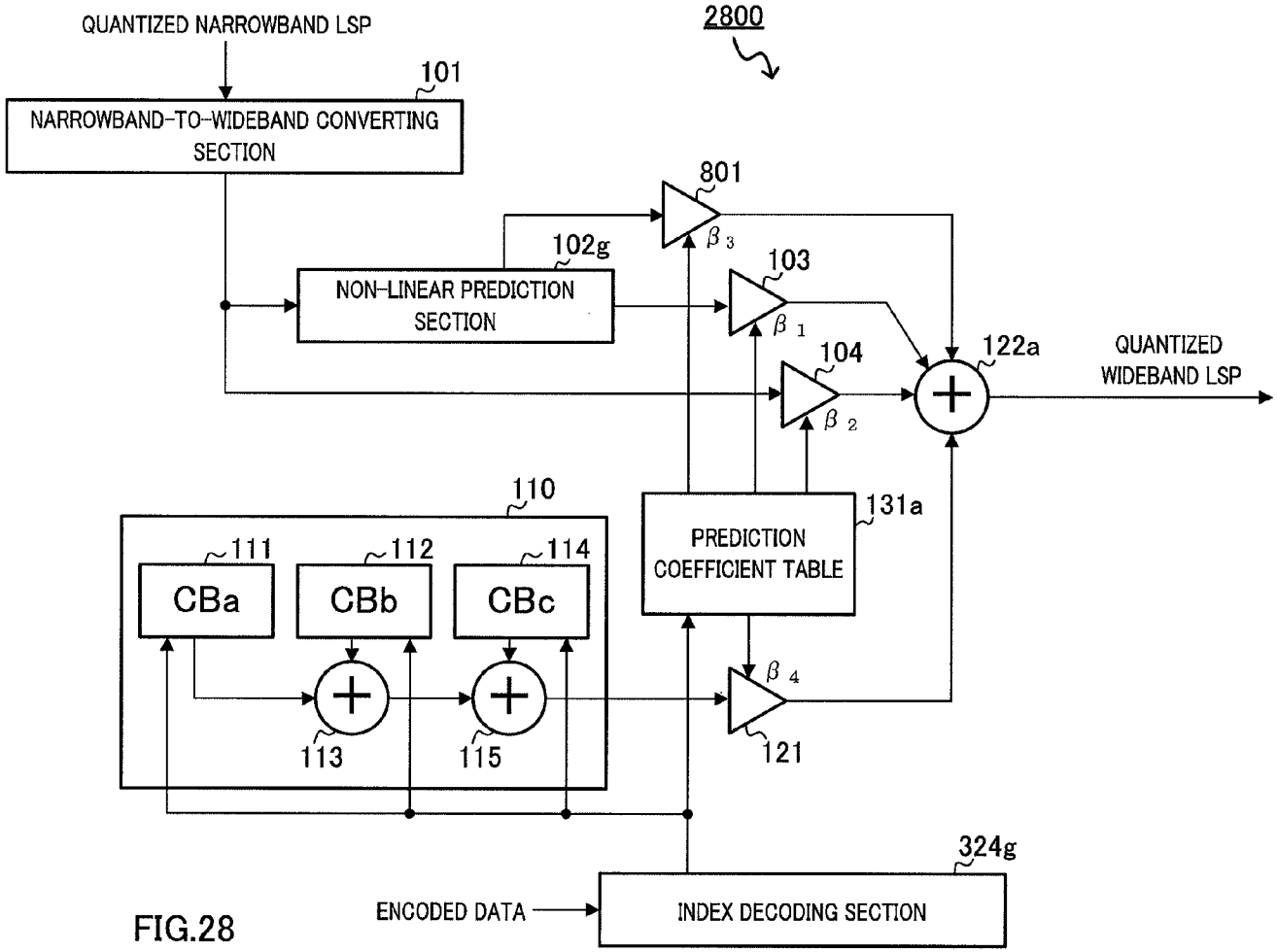
FIG. 28 is a block diagram showing main components of a wideband decoding apparatus according to Embodiment 8.

FIG. 28 is a block diagram showing the main components of wideband decoding apparatus 2800 for decoding encoded data generated by wideband coding apparatus 2600 according to the present embodiment. Wideband decoding apparatus 2800 has a large number of components performing the same operations as in wideband decoding apparatus 1000 according to Embodiment 3, therefore, components of wideband decoding apparatus 2800 different from wideband decoding apparatus 1000 will be described for avoiding repetition.

In wideband decoding apparatus 2800 according to the present embodiment, encoded data includes selection information of a set of wideband code vectors outputted from non-linear prediction section 102*g* and classification code vectors in addition to information included in encoded data of Embodiment 3. Here, index decoding section 324*g* decodes above selection information from this encoded data and output the results to non-linear prediction section 102*g*. Non-linear prediction section 102*g* obtains wideband code vectors and classification code vectors based on inputted selection information, and outputs wideband code vectors to amplifier 103 and classification code vectors to amplifier 801. The internal configuration of non-linear prediction section 102*g* is the same as non-linear prediction section 102*g* shown in FIG. 27, therefore, the same components are not described here.

Non-linear prediction section 102*g*, difference minimization determining section 124*g*, and index decoding section 324*g* according to the present embodiment may also be applied to Embodiment 4.

The embodiments of the present invention have been described.

The wideband coding apparatus of the present invention is by no means limited to the embodiments described above, and various modifications thereof are possible.

The wideband coding apparatus according to the present invention can be mounted on communication terminal apparatus of a mobile communication system and base station apparatus, and it is possible to provide communication terminal apparatus, base station apparatus and mobile communication systems having the same effects and advantages as described above.

LSP may also be referred to as LSF (Line Spectral Frequency). Although a case may be described where LSP and LSF are distinguished (for example, in ITU-T recommendation G.729, LSP defined as LSF with the cosine removed), but in this specification the two are not distinct and are the synonym. Namely, LSP and LSP are interchangeable.

Further, here, although a case has been described as an example where prediction and encoding targets of the present invention are LSPs, it is possible to apply the invention to prediction and encoding of spectral envelope parameters other than LSP. FFT (Fast Fourier transforms) power spectrum and envelope information of MDCT (Modified Discrete Cosine Transforms) may be given as specific examples of spectral envelope parameters. In this case, up-sampling in narrowband-to-wideband converting section 101 takes narrowband spectral envelope parameters as spectrum envelope parameters of low band section and is generally implemented by filling zero in the high band section. Further, LPC (Linear Prediction Coefficients) that are parameters that can be mutually converted with LSP, PARCOR coefficients (partial autocorrelation coefficients), autocorrelation coefficients, LPC cepstrum, and reflection coefficients may also be included in spectral envelope information. In this case, in up-sampling in narrowband-to-wideband converting section 101, these parameters to LSPs are may be temporally converted and the results may be up-sampled as described in the embodiments or up-sampling may be implemented by inserting (interpolating) data in LPC cepstrum or autocorrelation function regions. Although several interpolation methods are known for data insertion, a method implemented using interpolation filters employing the SINC function are relatively widely utilized. Processing for inserting data using an interpolation filter employing the SINC function is disclosed, for example, in ITU-T recommendation G.729, and is used in adaptive codebook excitation vector generation and autocorrelation function insertion in pitch search. The operation of blocks other than narrowband-to-wideband converting section 101 may replace LSP according to the embodiments with respective parameters.

Although cases have been described in the present specification where quantized narrowband LSP inputted to nonlinear prediction section 102 are taken to be LSP up-sampled by narrowband-to-wideband converting section 101, quantized narrowband LSPs up-sampled without passing through narrowband-to-wideband converting section 101 may also be possible.

Moreover, cases have been described as an example where the present invention is configured using hardware but it is also possible to implement the present invention using software. For example, it is possible to implement the same functions as in the wideband LSP prediction apparatus of the present invention by describing algorithms of the wideband LSP prediction methods according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" due to differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Moreover, if integrated circuit technology comes out to replace LSI's as a result of the advancement of semiconductor technology or a derivative other technology, it is naturally also possible to carry out function block integration using this technology. Application in biotechnology is also possible.

This specification is based on Japanese Patent Application No. 2004-358260, filed on Dec. 10, 2004, Japanese Patent Application No. 2005-095345, filed on Mar. 29, 2005, and Japanese Patent Application No. 2005-286532 filed on Sep. 30, 2005, the entire content of which is expressly incorporated by reference herein.

Industrial Applicability

The wideband coding apparatus according to the present invention has an advantage of implementing superior prediction performance of a prediction equipment and improving quantization efficiency of a quantization equipment by using nonlinear prediction which is implemented with a limited amount of memory in band-scaleable encoding and decoding of speech signals, and is useful in communication terminal apparatus such as mobile telephones that include the limited, available amount of memory and that is forced to perform slow radio communication.

The invention claimed is:

1. A wideband coding apparatus, that encodes a wideband Line Spectrum Pair using a quantized narrowband Line Spectrum Pair of a speech signal, comprising:

a first converter, embodied by a processor, that converts the quantized narrowband Line Spectrum Pair to a first Line Spectrum Pair comprising information about the quantized narrowband Line Spectrum Pair by up-sampling;

a second converter, embodied by a processor, that comprises a conversion table stored by associating a narrowband Line Spectrum Pair with a wideband Line Spectrum Pair, specifies the wideband Line Spectrum Pair stored in the conversion table by calculation of the first Line Spectrum Pair and the narrowband Line Spectrum Pair stored in the conversion table, and outputs the specified wideband Line Spectrum Pair as a second Line Spectrum Pair;

a generator, embodied by a processor, that generates a predicted wideband Line Spectrum Pair using a weighted sum of the first Line Spectrum Pair and the second Line Spectrum Pair; and an encoder, embodied by a processor, that obtains encoded data that minimizes the difference between the predicted wideband Line Spectrum Pair and the wideband Line Spectrum Pair.

2. The wideband coding apparatus of claim 1, wherein the second converter comprises:

a classification codebook comprising a plurality of classification code vectors which are reference vectors representing the first Line Spectrum Pair;

a difference calculator that calculates a difference between the first Line Spectrum Pair and a classification code vector in the classification codebook;

a minimizer that outputs a classification code vector that minimizes a difference calculated in the difference calculator in the classification codebook, and further outputs an index of the output classification code vector; and a first wideband codebook that comprises a plurality of wideband code vectors, each paired with one of the plurality of classification code vectors, and that comprises the same index as an index output from a minimizing section and specifies a wideband code vector paired with one of a plurality of classification code vectors as the wideband Line Spectrum Pair.

3. The wideband coding apparatus of claim 2, wherein the generator uses a weighted sum of the first Line Spectrum Pair, the second Line Spectrum Pair, and the classification code vector output by the minimizer, in place of the weighted sum of the first Line Spectrum Pair and the second Line Spectrum Pair.

4. The wideband coding apparatus of claim 2, wherein the generator uses the difference between the first Line Spectrum Pair and the classification code vector output by the minimizer, in place of the first Line Spectrum Pair.

5. A wideband Line Spectrum Pair prediction apparatus, that predicts a wideband Line Spectrum Pair from a quantized narrowband Line Spectrum Pair of a speech signal, the wideband Line Spectrum Pair prediction apparatus comprising:

a first converter, embodied by a processor, that converts the quantized narrowband Line Spectrum Pair to a first Line Spectrum Pair comprising information about the quantized narrowband Line Spectrum Pair by up-sampling;

a second converter, embodied by a processor, that comprises a conversion table stored by associating a narrowband Line Spectrum Pair with a wideband Line Spectrum Pair, specifies the wideband Line Spectrum Pair stored in the conversion table by calculation of the first Line Spectrum Pair and the narrowband Line Spectrum Pair stored in the conversion table, and outputs the specified wideband Line Spectrum Pair as a second Line Spectrum Pair;

a generator, embodied by a processor, that generates a predicted wideband Line Spectrum Pair using a weighted sum of the first Line Spectrum Pair and the second Line Spectrum Pair.

6. A band-scaleable coding apparatus, comprising:

a narrowband encoder, embodied by a processor, that encodes a narrowband Line Spectrum Pair of a speech signal and generates a quantized narrowband Line Spectrum Pair; and a wideband encoder, embodied by a processor, that encodes a wideband Line Spectrum Pair of the speech signal using the quantized narrowband Line Spectrum Pair, wherein the wideband encoder comprises:

a first converter that converts the quantized narrowband Line Spectrum Pair to a first Line Spectrum Pair comprising information about the quantized narrowband Line Spectrum Pair by up-sampling;

a second converter that comprises a conversion table stored by associating a narrowband Line Spectrum Pair with a wideband Line Spectrum Pair, specifies the wideband Line Spectrum Pair stored in the conversion table by calculation of the first Line Spectrum Pair and the narrowband Line Spectrum Pair stored in the conversion table, and outputs the specified wideband Line Spectrum Pair as a second Line Spectrum Pair;

a generator that generates a predicted wideband Line Spectrum Pair using a weighted sum of the first Line Spectrum Pair and the second Line Spectrum Pair; and an encoder that obtains encoded data that minimize a difference between the predicted wideband Line Spectrum Pair and the wideband Line Spectrum Pair.

7. A band-scaleable decoding apparatus, comprising:

a narrowband decoder, embodied by a processor, that decodes encoded data representing a quantized narrowband Line Spectrum Pair of a speech signal and generates a quantized narrowband Line Spectrum Pair;

a decoder, embodied by a processor, that decodes encoded data related to the quantized wideband Line Spectrum Pair of the speech signal; and a wideband decoder, embodied by a processor, that generates a quantized wideband Line Spectrum Pair from the quantized narrowband Line Spectrum Pair in accordance with information related to the quantized wideband Line Spectrum Pair decoded by the decoder, wherein the wideband decoder comprises:

a first converter that converts the quantized narrowband Line Spectrum Pair to a first Line Spectrum Pair comprising information about the quantized narrowband Line Spectrum Pair by up-sampling;

a second converter that comprises a conversion table stored by associating a narrowband Line Spectrum Pair with a wideband Line Spectrum Pair, specifies the wideband Line Spectrum Pair stored in the conversion table by calculation of the first Line Spectrum Pair and the narrowband Line Spectrum Pair stored in the conversion table, and outputs the specified wideband Line Spectrum Pair as a second Line Spectrum Pair;

a generator that generates a quantized wideband Line Spectrum Pair using a weighted sum of the first Line Spectrum Pair and the second Line Spectrum Pair in accordance with the information.

8. A communication terminal apparatus comprising the wideband coding apparatus according to claim 1.

9. A base station apparatus comprising the wideband coding apparatus according to claim 1.

10. A wideband encoding method that encodes a wideband Line Spectrum Pair using a quantized narrowband Line Spectrum Pair of a speech signal, the wideband encoding method comprising:

converting the quantized narrowband Line Spectrum Pair to a first Line Spectrum Pair comprising information about the quantized narrowband Line Spectrum Pair by up-sampling;

having a conversion table stored by associating a narrowband Line Spectrum Pair with a wideband Line Spectrum Pair, specifying the wideband Line Spectrum Pair stored in the conversion table by calculation of the first Line Spectrum Pair and the narrowband Line Spectrum Pair stored in the conversion table, and outputting the specified wideband Line Spectrum Pair as a second Line Spectrum Pair;

generating a predicted wideband Line Spectrum Pair using a weighted sum of the first Line Spectrum Pair and the second Line Spectrum Pair; and obtaining encoded data that minimize a difference between the predicted wideband Line Spectrum Pair and the wideband Line Spectrum Pair.

* * * * *